US009947173B2

(12) United States Patent
Tennenhaus et al.

(10) Patent No.: US 9,947,173 B2
(45) Date of Patent: Apr. 17, 2018

(54) PROVIDING PERFORMANCE VIDEO CONTENT IN AN ONLINE CASINO

(71) Applicant: Big Fish Games, Inc, Seattle, WA (US)

(72) Inventors: Shmuel Tennenhaus, Seattle, WA (US); Carey DiJulio, Seattle, WA (US)

(73) Assignee: Big Fish Games, Inc., Seattle, WA (US)

( * ) Notice: Subject to any disclaimer, the term of this patent is extended or adjusted under 35 U.S.C. 154(b) by 607 days.

(21) Appl. No.: 14/462,533

(22) Filed: Aug. 18, 2014

(65) Prior Publication Data

US 2016/0049043 A1 Feb. 18, 2016

(51) Int. Cl.
*G07F 17/00* (2006.01)
*G07F 17/32* (2006.01)

(52) U.S. Cl.
CPC ..... *G07F 17/3225* (2013.01); *G07F 17/326* (2013.01)

(58) Field of Classification Search
CPC ..... G07F 17/32; G07F 17/00
See application file for complete search history.

(56) References Cited

U.S. PATENT DOCUMENTS 8,152,631 B2 4/2012 Anderson ..... 463/25
8,556,722 B2 10/2013 Novi et al. ..... 463/42
2003/0119585 A1* 6/2003 Walker ..... G06Q 40/08 463/25
2003/0227473 A1 12/2003 Shih et al. ..... 345/716
2008/0220849 A1 9/2008 Wadleigh et al. ..... 463/20
2008/0274798 A1* 11/2008 Walker ..... G07F 17/32 463/25

FOREIGN PATENT DOCUMENTS

WO 2008106197 9/2008

OTHER PUBLICATIONS

Live Performances—Second Life Wiki; URL: http://wiki.secondlife.com/wiki/Live_Performance, retrieved online on Jan. 17, 2014.

* cited by examiner

*Primary Examiner* — Reginald Renwick
(74) *Attorney, Agent, or Firm* — Sheppard Mullin Richter & Hampton LLP

(57) ABSTRACT

A system and method for providing performance video content in an online casino are disclosed. Players of the online casino may be facilitated to access (e.g., viewing, browsing and/or any other types of access) the performance video content and simultaneously play casino-style games provided in the online through casino interfaces. For incentivizing the players to engage the online casino, access to the performance video content may be differentiated based on progress by the players in the online casino. The access to the performance video content may be differentiated with respect to streaming quality, video resolution, types of content available, periods of access, means to access past video on demand, and/or any other aspects of accessing the performance video content within the online casino.

51 Claims, 9 Drawing Sheets

402b

Milestones Achieved By A Given Player Casino-Style Game #1 (e.g., Hold'Em)

Won A Hand (Achieved)

Won 10 Hands (Achieved)

.....

Won A Hand After "All-In" (Achieved)

Pushed 10 Hands After "All-In" (Not Achieved)

.....

Won With A Big Slick (A-K) (Achieved)

Won With A King Kong (K-K) (Not Achieved)

.....

Won With One Of The 5 Worst Starting Hands (Achieved)

Get Every One To Fold 10 Times (Achieved)

.....

.....

Eliminate An Opponent (Achieved)

Eliminate 10 Opponents (Not Achieved)

.....

Won With A 6 Straight Flush (Achieved)

Won 50 Hands at $100,000+ Min Chip Tables (Not Achieved)

.....

.....

FIG. 6

402c

Milestones Achieved By A Given Player Casino-Style Game #2 (e.g., Blackjack)

Draw a First Blackjack (Achieved)

Draw 10 Blackjacks (Not Achieved)

.....

Pushed a Hand (Achieved)

Pushed 50 Hands (Not Achieved)

.....

Won A Hand (Achieved)

Won 250 Hands (Not Achieved)

.....

Split A Hand Once and Won Both (Achieved)

Split A Hand Twice and Won All Three (Achieved)

.....

.....

Double Down And Won (Achieved)

Double Down Against Odds and Won (Achieved)

.....

Won With A 6 Card Charlie (Achieved)

Won 50 Hands at $100,000+ Min Chip Tables (Not Achieved)

.....

.....

FIG. 7

PROVIDING PERFORMANCE VIDEO CONTENT IN AN ONLINE CASINO

FIELD OF THE DISCLOSURE

This disclosure relates to facilitating player engagement in an online casino by providing performance video content in the online casino.

BACKGROUND

Online casinos enabling players to place wagers in casino games provided therein are generally known. In a conventional online casino, multiple players are typically connected with one another over the Internet to engage in casino games through client computing platforms associated with the multiple players. Some online casinos may enable players to wager real-word money on the casino games, while some other online casinos may enable players to wager virtual money on the casino games. Outcomes of a given casino game in a conventional online casino are typically determined by a pseudorandom number generator (PRNG). For example, a PRNG may be employed to determine the order of the cards in card games, the outcome of a dice roll, and/any other types of outcomes of the given online casino game.

Streaming video content over the Internet to a client computing platform is generally known. The amount of data required for streaming particular video content typically depends on the length and/or the streaming quality of the video content. Bandwidth for streaming video content to client computing platforms is typically provided by Internet service providers for a charge.

SUMMARY

One aspect of the disclosure relates to providing performance video content in an online casino. Players of the online casino may be facilitated to access the performance video content within the online casino through casino interfaces. Accessing the performance video content through the casino interfaces by the players may include viewing the performance video content and placing wagers in casino-style games provided by the online casino simultaneously. For incentivizing the players to engage the online casino, access to the performance video content may be differentiated based on players' progress in the online casino. The access to the performance video content may be differentiated with respect to streaming quality, video resolution, types of content available, periods of access, means to access past video on demand, and/or any other aspects of accessing the performance video content within the online casino. This may improve player retention and thus enhance monetization opportunities for the provider(s) of the online casino. This may incentivize new players to join the online casino.

In some implementations, offers of virtual currencies, items, chips, and/or any other types of virtual objects usable in the online casino may be presented to the players in connection with the streaming of the performance video content within the online casino. In some implementations, players may be enabled to make reservations for viewing the performance video content within the online casino and may be reminded about their performance video content reservations. In some implementations, players may be enabled to interact with the performers of performance video content, to cast votes regarding the performance video content, and/or to perform any other types of acts in connection with the performance video content. In some implementations, players may be enabled to invite friends to join the online casino to view the performance video content. These implementations may enhance player engagement in the online casino and enhance monetization opportunities for the provider(s) of the online casino.

A system configured to provide performance video content in an online casino may include one or more servers. The servers may operate in a client/server architecture with one or more client computing platforms. The client computing platforms may be associated with the players of the online casino. The servers may be configured to execute one or more of: a casino component, a player component, a performance video content component, an access management component, an interface component, a ticket component, a chat component, a schedule component, a reservation component, a notification component, an offer component, a content interaction component, and/or any other components.

The casino component may be configured to host an online casino for player participation. Hosting the online casino may involve providing multiple casino-style games for player participation. Providing a given casino-style game in the online casino through the casino component may involve simulating games of chance, which may involve producing stochastic or quasi-stochastic outcomes for a given casino-style game after a player or players place wagers in the game. The simulation of a given casino-style game by the casino component may involve generating a pseudorandom number. The given casino-style game may be a multiplayer game wherein multiple players are enabled to engage in the game against the dealer(s) or against each other. The casino component may be configured to enable players to place wagers. Examples of casino-style games provided by the casino component may include virtual slot, poker, blackjack, roulette, bingo, pachinko, baccarat, raffles, lottery, sports betting, and/or any other casino-style games. A given casino-style game provided by the casino component may be a single player game wherein only one player is enabled to engage in the game.

The player component may be configured to manage player accounts associated with the players of the online casino hosted by the casino component. The individual player accounts managed by the player component may include player information associated with players of the online casino. The player information in a given player's account may include progress information indicating progress made by the given player in the online casino. Progress made by a given player in the online casino may reflect events, activities, actions, winnings, losses, purchases, social interaction with other players, and/or any other types of progress made by the given player during the given player's engagement with the online casino. Player information in a given player's account that may indicate given player's progress in the online casino may include information indicating historical purchase(s), purchases within one or more time periods, current balance, stored balance, and/or any other types of statistics regarding balances or purchases of virtual items, currencies, chips, bets, tickets, and/or any other elements in the online casino related to the given player. The player information in a given player's account may indicate progress made by the given player in the online casino by reflecting one or more in-game events encountered, awards received, statuses reached, records acquired, and/or any other types of statistics regarding play by the given player in the online casino. The player information in the given player's account may indicate progress made by the given player in the online casino by conveying one or more level attributes associated with the given player. The player information in a given player's account may indicate progress made by the given player in the online casino by reflecting a number of friends connected and/or invited by the given player in the online casino, a number of virtual gifts given to other players or friends in the online casino, a number of virtual gifts received by the given player from other players, and/or any other statistics related to social activities engaged in by the given player in the online game. In some implementations, user progress in an event, such as progress in a tournament or another promotional event provided in the online casino, may be captured and managed through the progress information included in the player account.

The performance video content component may be configured to manage one or more sets of performance video content for the online casino. A given set of performance video content managed by the performance video content component may contain performance by one or more performers. Examples of performances in the given set of performance video content may include, without limitation, a talk show, a concert, comedy, a musical show, a magic show, an educational show, a dance show, and/or any other types of performance. The performance in the given set of performance video content may be live, near-live, and/or recorded. Managing the one or more sets of performance video content by the performance video content component may involve adding/modifying attribute information, captioning, categorizing, archiving, tagging, storing, automatically deleting, sorting, and/or any other types of operations for managing the set(s) of performance video content. In some implementations, managing the sets of video content by the performance video content component may include facilitating video content creation on demand, and/or any other types of on-demand requests for altering the sets of the video content managed by the performance video content component. In some implementations, managing the sets of video content by the performance video content component may include managing edited versions of the video content. In some implementations, the provider(s) of the online casino may maintain the performance video content on its own. For instance, the provider(s) of the online casino may employ one or more studios to feed a live performance by a performer in the studio to a streaming-cast server. In another implementation, the online casino may arrange individual performers to perform at locations of their choice. For instance, the performers may be provided equipment such as video cameras, lighting devices, and/or any other devices that can be set up in rooms where the performers perform their shows. In some implementations, some or all of the set(s) of video content managed by the performance video content component 116 may be from a resource external to the online casino.

The access management component may be configured to provide the players of the online casino access to the of performance video content managed by the performance video content component. Access of the performance video content by a given player in the online casino may involve the player viewing the performance video content while placing wagers in casino game(s) by the given player. A given player's access to the performance video content may be managed by the access management component based on the progress of the given player in the online casino as reflected by the player information in the given player's account managed by the player component. For incentivizing players to engage the online casino, access to the performance video content may be differentiated based on player progress in the online casino. Providing players differentiated access to the performance video content through the access management component may involve examining player information managed by the player component for determining progress of the players in the online casino. A number of aspects of access to the performance video content may be differentiated based on player progress in the online casino. For example, without limitation, access may be differentiated with respect to streaming quality, video resolution, available controls, and/or any other aspects regarding the presentation of the performance video content, or to particular video clips or segments of the performance video content.

In some implementations, access to the performance video content may be differentiated with respect to the availability of the performance video content to the players. In some implementations, access may be differentiated by the type of performance video content available to the players based on their progress in the online casino. In some implementations, differentiated access to the performance video content provided by the access management component may be based on a player's access period. In some implementations, differentiated access to the performance video content provided by the access management component may be based on available methods of access. In some implementations, access to the performance video content as provided by the access management component may be differentiated as types of payout in a casino-style game. In some implementations, the differentiated access to the performance video content as provided by the access management component may be based on tickets purchased by the players within the casino.

The interface component may be configured to provide one or more casino interfaces for presentation on client computing platforms. Providing a given casino interface by the interface component may involve determining view information regarding a view of the online casino. The view information determined for a player may reflect a view of the online casino from the player's perspective. The view information may be employed by the interface component to provide a given casino interface on a client computing platform. The casino interface provided by the interface component may include controls that facilitate a given player to play a casino-style game. The casino interface may include an area where performance video content may be presented to the player. In some implementations, one or more sections of the online casino may be associated with a virtual stage or theater such that the stage or theater may be viewed from an angle corresponding to a given section of the online casino.

The ticket component may be configured to facilitate tickets for use by players within the online casino. Tickets acquired by a given player in the online casino may be spent by a player for acquiring and/or improving access to performance video content within the online casino. For example, without limitation, live performance video content (e.g., a live comedy show) may be provided in the online casino to a given player in exchange for one or more tickets. In another example, the given player may be enabled to purchase access to performance video content on demand with tickets. In some implementations, tickets may be spent by the given player to improve access to the performance video content, to access exclusive areas to view the performance video content, and/or to engage in any other activities in the online casino. In implementations, users may be enabled to acquire tickets in the online casino game in a variety of ways including, but not limited to, purchasing the tickets with virtual currency, acquiring the tickets by playing the casino games provides, be-gifted the tickets from other users in the online casino, and/or any other ways.

The chat component may be configured to implement chat sessions to facilitate synchronous textual communications between players within the online casino and to provide chat interfaces to facilitate textual communications between the players of the online casino and/or communications between the players and performer(s) of performance video content. In some implementations, the chat interfaces provided by the chat component may form a part of a given casino interface provided by the interface component. In some implementations, the chat interface may simulate a room within the online casino such that a group communications may be enabled through the room view chart interface and be limited to a subset of players within the casino environment. The chat interface may facilitate the players to interact with performer(s) of performance video content presented to the players while playing a casino-style game through the casino interface.

The schedule component may be configured to provide schedules of multiple sets of performance video content available for access by players in the online casino. To provide the schedules, the schedule component may generate graphical information for presenting a schedule of multiple sets of performance video content to the players. In some implementations, the schedule may be presented in a casino interface such as the casino interface provided by the interface component. In some implementations, the schedule may be presented in the casino interface in a rolling manner such that the presentation of the schedule may appear to be animated. In some implementations, the schedule component may be configured to organize the schedules presented to the players based on the casino content, player demographics, the layout of individual games where the schedule is presented, and/or any other consideration.

The reservation component may be configured to enable the players of the online casino to register as audience to view the performance video content in a time period when the performance video content is available in the online casino. In some implementations, the reservation component may be configured to provide RSVP options to the players in a prioritized manner based on their progress in the online casino. In some implementations, the reservation component may be configured to facilitate the players to incorporate the date and/or time of a reserved set of performance video content into one or more calendars provided by an Internet service provider associated with the players. For example, without limitation, a given player may be facilitated by to incorporate the dates and/or time of the set(s) of performance video content he/she has reserved into the calendars the given player has linked to his/her account in the online casino. Examples of such calendars may include calendars provided by Facebook™, Google™, Outlook™, Eventribe™, and/or any other Internet service providers. In some implementations, the reservation component may be configured to facilitate a player to reserve a private showing of performance video content for his/her friends.

The notification component may be configured to generate notifications for reminding the players that they are registered to view sets of performance video content in the online casino during reserved time periods. The notifications generated by the notification component may include information for reminding a given player that one or more sets of performance video content reserved by the given player are going to be available in the online casino on the dates in accordance with the schedule provided by the schedule component. The notification component may be configured to effectuate transmission of the notifications through electronic communication media internal to and/or external to online casino. This may involve determining which of one or more communication media the notifications may be transmitted to the corresponding players, and/or other aspects regarding the notifications. For example, the notification component may effectuate transmission of notifications to a given player through a casino interface whenever the given player first interacts with the casino interface in the online casino; and it may effectuate the transmission of the notifications to the given player through external medium such as email, instant messages, push notifications, text messages and/or any other external medium when the given player is not interacting with the online casino (e.g., the given player is not logged on or the given player is idle in the online casino for an extended period of time).

The offer component may be configured to provide offers for presentation to the players through the casino interfaces. An offer provided by the offer component may include virtual items, currencies, chips, tickets and/or any other objects usable in the online casino. The offer may facilitate a player to purchase the objects included in the offer. Providing such an offer may involve presenting the offers in connection with one or more sets of performance video content. For example, without limitation, promotional sale of chips or a gameplay tournament may be held during the streaming of live performance video content in the online casino. As another example, offers of virtual items such as virtual gifts may be presented to players through the casino interface to the players during a period prior to the streaming of the performance video content. In some implementations, information regarding offers provided by the offer component in connection with the performance video content may be included in notifications generated by the notification component for transmission to the players. For example, without limitation, emails may be transmitted to the players that have not logged into the online casino for an extended period of time to notify them that chips are on sale during the streaming of a live performance video content that is currently underway.

The invitation component may be configured to facilitate players to invite friends to access the performance video content within the online casino. This may involve receiving inputs from the players indicating one or more friends they would like to invite to the online casino to access one or more sets of performance video content. The invitation component may be configured to compose an invitation message addressed to such friends, expressing that players would like to invite them to view performance video content in the online casino. In some implementations, the invitation component may receive the invitation message from the player. In some implementations, the invitation component may be configured to track whether the friends accept the invitation messages composed by the invitation component.

The content interaction component may be configured to facilitate the players to interact with the performance video content. A given player may be facilitated by the content interaction component to interact with performance video content in a number of ways. For example, without limitation, the given player may be enabled to give virtual gifts to the performer(s) of performance video content during streaming of the performance video content in the online casino. In some examples, the content interaction component may be configured to enable the given player to participate in the performance of performance video content. In some implementations, the content interaction component may be configured to enable the given player to cast votes during and/or after the streaming of performance video content in the online casino. In some implementations, the content interaction component may be configured to facilitate the given player to request the performer(s) to perform a specific act during the performance. In some implementations, offers enabling the given player to request such special performance may be presented to the given player in exchange for consideration. In some implementations, the content interaction component may be configured to provide a player a level of content interaction based on virtual currency paid by the player for the level of content interaction, progress in the online game, progress in an event (e.g., a tournament), contents or player status in the online game, and/or any consideration.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

FIG. 6 illustrates another example of the content of the milestone information shown in FIG. 4.

FIG. 7 illustrates yet another example of the content of the milestone information shown in FIG. 4.

DETAILED DESCRIPTION

Figure 1:
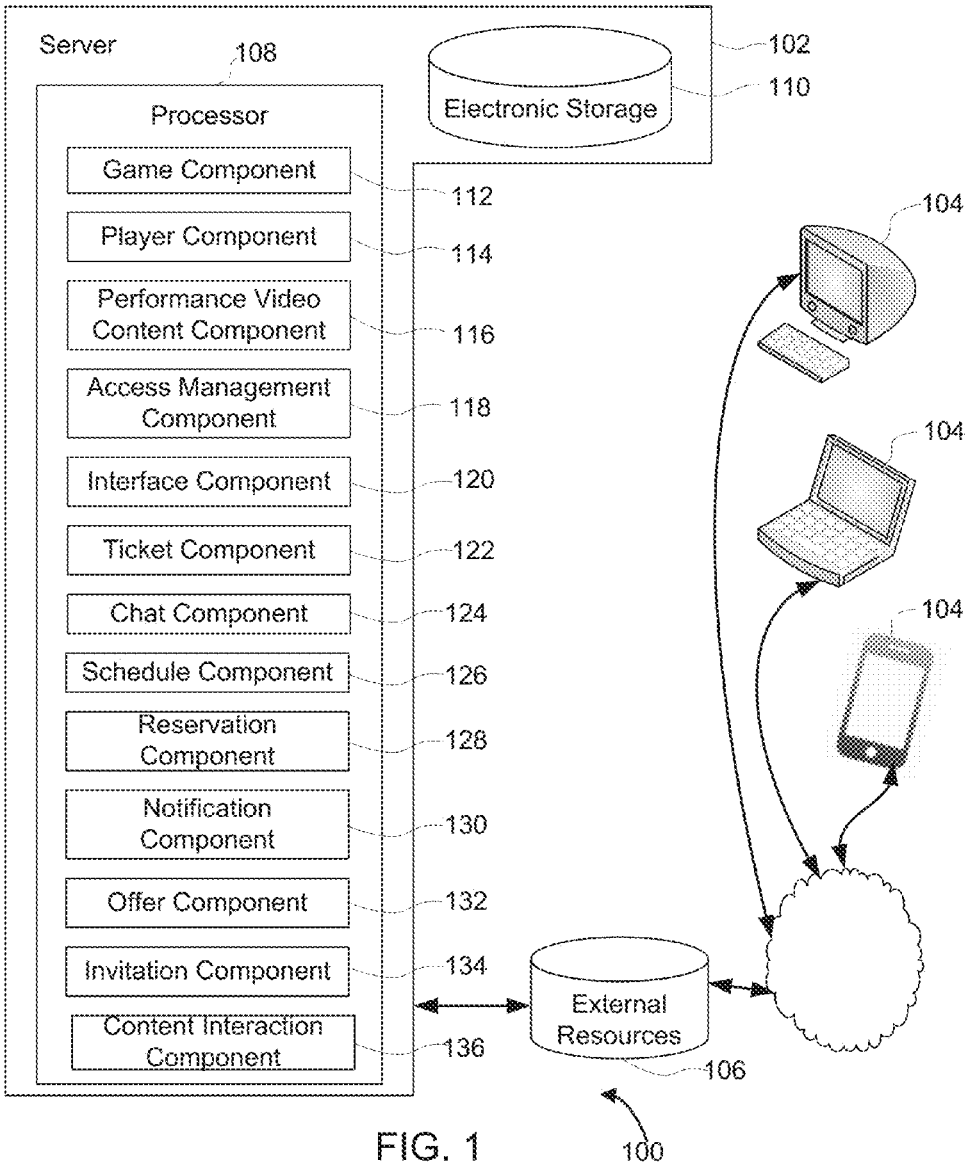
FIG. 1 illustrates a system configured for providing performance video content in an online casino.

FIG. 1 illustrates a system 100 for providing performance video content in an online casino. Providing performance video content in the online casino may involve hosting the online casino over a network. In some implementations, as shown in this example, system 100 may include a server 102 configured for hosting the online casino. The server 102 may be configured to communicate with one or more client computing platforms 104 according to a client/server architecture. Players may interact with the online casino via client computing platforms 104 associated with the players. As shown, server 102 may include processors 108 configured to execute computer-readable instructions to implement system components. The computer program components may include one or more of a casino component 112, a player component 114, a performance video content component 116, an access management component 118, an interface component 120, a ticket component 122, a chat component 124, a schedule component 126, a reservation component 128, a notification component 130, an offer component 132, an invitation component 134, a content interaction component 136 and/or any other components.

The casino component 112 may be configured to host an online casino for player participation. Hosting the online casino by the casino component 112 may involve providing multiple casino-style games for player participation. Providing a given casino-style game in the online casino through the casino component 112 may involve simulating games of chance, which may involve producing a stochastic or quasi-stochastic outcome for the given casino-style game after a player or players place wagers in the game. In producing a casino-style game outcome, one or more devices typically found in games of chance may be simulated. Common examples of such devices may include dice, spinning tops, playing cards, roulette, shuffling devices, wheels or numbered balls drawn from a container, and/or any other devices.

Simulation of a given casino-style game by the casino component 112 may involve generating a pseudorandom number. By way of non-limiting example, a dice roll may be simulated by generating a pseudorandom number indicating a particular resting position of the dice after the roll. As another example, a generated pseudorandom number may be used to simulate the stopping position of a spinning wheel or wheels on a slot, roulette, or any other wheel-based gaming device. As still another example, a generated pseudorandom number may be used to simulate the drawing and/or shuffling of cards. Based on such simulation, the casino component 112 may be configured to determine an outcome of the given casino-style game. For example, without limitation, an outcome of a virtual slot game provided by the casino component 112 may be determined based on the simulation of a pull by a player in a the virtual slot game within the online casino.

The casino component 112 may be configured to enable players to place wagers. The wagers in the online casino may include real-world money credit, virtual currency, virtual items (e.g., tickets), stored credit (e.g., chips), points, and/or any other types of wagers. As will be discussed below in connection with the interface component 120, one or more casino interfaces may be presented to the players on client computing platforms 104 such that the players may be enabled to place wagers through the casino interfaces. By way of non-limiting example, in one implementation, players of the online casino may be enabled by the casino component 112 to place tickets through a casino interface on one of multiple boxes shown in the casino interface for winning content inside the box. As another example, players of the online casino may be enabled to place wagers in a blackjack game. As yet another example, players of the online casino may be enabled to place bets through a casino interface to play virtual slot games within the online casino.

Some examples of the casino-style games provided in the online casino hosted by the casino component 112 may include virtual slot, poker, blackjack, roulette, bingo, pachinko, baccarat, raffles, lottery, shell games, sports betting, and/or any other casino-style games.

In some implementations, the online casino hosted by the casino component 112 may enable multiple players to participate in one or more casino-style games provided by the online casino simultaneously. In those implementations, a given one of the multiple players is typically enabled to view, through a casino interface, other ones of the multiple players engaging in the casino-style game(s). For example, without limitation, in one implementation, the online casino may enable multiple players to play virtual slots simultaneously. In that implementation, through a casino interface, a portion or all of a virtual casino room may be presented through a casino interface to the players on the client computing platforms 104. Through a casino interface on the client computing platform 104, a given one of the multiple players may be enabled to view play actions by others playing the virtual slots. For instance, significant wins, major milestones achieved, bets placed, rare symbols achieved, and/or any other types of actions by other players may be presented to a given player through the casino interface. This may create a virtual casino environment in which the players of the online casino may feel connected with each other in a real-world casino. In some implementations, the online casino hosted by casino component 112 may have a lobby area where multiple casino-style games provided by the online casino may be presented for access by the players. In some implementations, players may interact with each other in the lobby area without necessarily engaging in any casino activities. For example, without limitation, the players may be enabled to interact with each other socially in the lobby area much like how they might interact with each other in a lobby area in a real-world casino.

In certain implementations, the online casino hosted by the casino component 112 may include a so-called "online social casino" as commonly known in the art. However, this is not intended to be limiting. In some other implementations, the online casino hosted by the casino component 112 may facilitate multiple players to engage in the casino-style games provided therein simultaneously, but may not necessarily include social elements with which the multiple players may interact with each other through the casino interface(s) of the online casino. For example, in one implementation, a player may be facilitated to play a given casino-style game in the online casino in solo mode; and multiple instances of such a solo casino-style game may be played by multiple players at any given time within the online casino.

The player component 114 may be configured to manage player accounts associated with the players of the online casino hosted by the casino component 112. The individual player accounts managed by the player component 114 may include player information associated with players of the online casino. The player information may include information stored by server 102, by one or more of the client computing platforms 104, and/or by other storage locations. The player information may include, for example, information identifying players (e.g., a player name or handle, a number, an identifier, and/or other identifying information) within the online casino, security login information (e.g., a login code or password), account information, subscription information, virtual currency account information (e.g., information related to currency held in credit for a player), relationship information (e.g., information related to relationships between players in the online casino), usage information, demographic information associated with players, interaction history among players in the online casino, a player's purchase information, a client computing platform identification associated with a player, a phone number associated with a player, and/or other information related to players. The player information in a given player's account may include progress information indicating progress made by the given player in the online casino. Progress made by a given player in the online casino may reflect events, activities, actions, winnings, losses, purchases, social interaction with other players, milestones achieved, and/or any other types of progress by the given player in the online casino.

Figure 2:
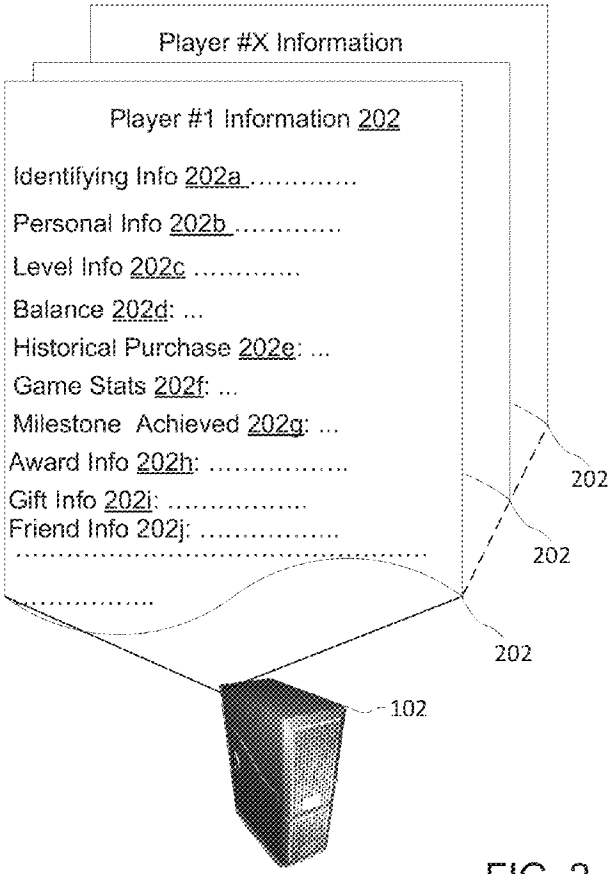
FIG. 2 illustrates one example of player information managed for individual players of the online casino.

FIG. 2 illustrates one example of player information managed by server 102 for individual players of the online casino. It will be described with reference to FIG. 1. As can be seen from FIG. 2, player information 202 may be managed for individual players of the online casino. The player information regarding a given player, for example, player #1 as illustrated in FIG. 1, may include information reflecting various aspects about the given player in connection with the online casino. As shown, the player information 202 may include information 202*a* identifying a given player as described above; may include information 202*b* indicating personal information about the given player (e.g., hometown, education background, job, hobbies, favorite sports, movie(s), and/or any other personal information); information 202*c* indicating a level of experience of the given player in the online casino; may include information 202*d* indicating the current balance of wagers by the given player in the online casino (e.g., chip balance); may include purchase information 202*e* indicating historical purchases by the given player in the online casino; information 202*f* indicating game statistics about the given player's play in the online casino; information 202*g* indicating one or more milestones achieved by the given player in the online casino; information 202*h* indicating one or more awards received by the given player in the online casino; information 202*i* indicating one or more gifts received from or given to other players by the given player; may include information 202*k* indicating one or more friends invited, added and/or otherwise connected by the given player in the online casino; and/or may include any other type of player information.

One or more of the information 202 illustrated in FIG. 2 may reflect progress by the given player in the online casino.

For example, level information 202*c* may indicate progress by the given player in the online casino. The level information 202*c* may indicate a level of experience of the given player has achieved through play in the online casino. For example, a level of the given player may reflect a threshold number of casino-style games played, a threshold number or amount of winnings achieved, a threshold number or amount of loss incurred, a threshold number or amount of wagers placed, a cumulative balance of wagers acquired, a current balance of wagers available for betting, and/or any other metrics regarding the given player's play in the online casino. A level of the given player may be conveyed through level attribute(s). The level attribute(s) may be in a numerical format, e.g., in Arabic numbers, level 1, 2, 3, 4, and so on. However, this is not necessarily the only case. In some implementations, the level attribute(s) may be in a star format (e.g., a number of stars indicating the level of the given player), in an alphabet format (e.g., a small v indicates a lower level than a big V), in a pseudonym ranking format (e.g., a title associated with a level), or in any other formats. As should be clear, in some implementations, the given player may be associated with more than one level attribute in the online casino. For example, without limitation, different levels of various attributes may be associated with the given player to indicate various aspects regarding the given player's play in the online casino, e.g., level 1 in amount of winning, level 3 in amount of wagers placed, level 2 in total time spent in the online casino, and the like.

In some implementations, the level information 202*c* in the given player's account may indicate a number of points, scores, and/or any other scoring metrics. For example, without limitation, points may be awarded to the given player for participating in a casino-style game provided by the online casino. An example of a point rewarding scheme may include rewarding a first number of points (e.g., 5 points) upon the given player's completion of a particular play in the casino-style game; a second number of points (e.g., 10 points) upon the given player's completion of 100 plays in the casino-style game; a third number of points upon the given player's completion of 1000 plays in the casino-style game. In another point rewarding scheme, major events encountered by the given player in the casino-style game may be associated with a number of points to incentivize the given player. For instance, without limitation, in one implementation, every rare combination of cards dealt to the given player in a poker game may be associated with a corresponding number of points awarded to the given player, regardless whether those cards produce a winning outcome for the given player in the poker game. In that example, a balance of points in the given player's account thus may reflect or quantify relative experience with the online casino, and help to differentiate players. In another example, player points may be awarded to an individual player based on individual plays engaged by the player. For instance, a number of points may be awarded to a player upon the player completion of a specific play in a blackjack game or by the length of time they played at a slot machine.

The balance information 202*d* and purchase information 202*e* may indicate progress made by the given player in the online casino by reflecting historical purchase(s), purchases made within one or more time periods, current balance, stored balance, and/or any other types of statistics regarding balances or purchases by the given player of virtual items, currencies, chips, bets, tickets, and/or any other elements in the online casino. For example, without limitation, these information may indicate that the given player has purchased $120 worth of chips; has a current balance of 100,000 chips; has purchased 50,000 chips last week; has purchased 50 tickets usable in the online casino; and/or any other types of information indicating the balance and/or purchases by the given player in the online casino.

Game statistics information 202*f* may indicate progress made by the given player in the online casino through various statistics about the given player's play in the online casino. The statistics may be generally related to overall plays by the given player in the online casino, and/or related to plays specific to a casino-style game provided in the online casino. For example, without limitation, information 202*f* may indicate total winnings, biggest win, total losses, biggest loss, win/loss ratio per hand, and/or any other type of win-loss statistics regarding the given player's play in a given casino-style game provided by the online casino. As another example, the game statistics information 202*f* may indicate a number of hands played, special cards drawn, hands pushed, hands lost and/or any other types of play statistics by the given player in the given casino-style game provided by the online casino. Still as another example, the game statistics information 202*f* may indicate a number of hands won, hands played, players eliminated, best hands drawn and/or any other types of hand statistics by the given player in the casino-style game provided by the online casino.

It should be understood the player information illustrated in FIG. 2 is not necessarily limited to player's progress in the online casino in general. It is contemplated that the player information may include information indicating progress by the player in an event such as, but not limited to, a tournament, a quest, a campaign, a party, a competition, and/or any other type of events provided in the online casino.

Figure 3:
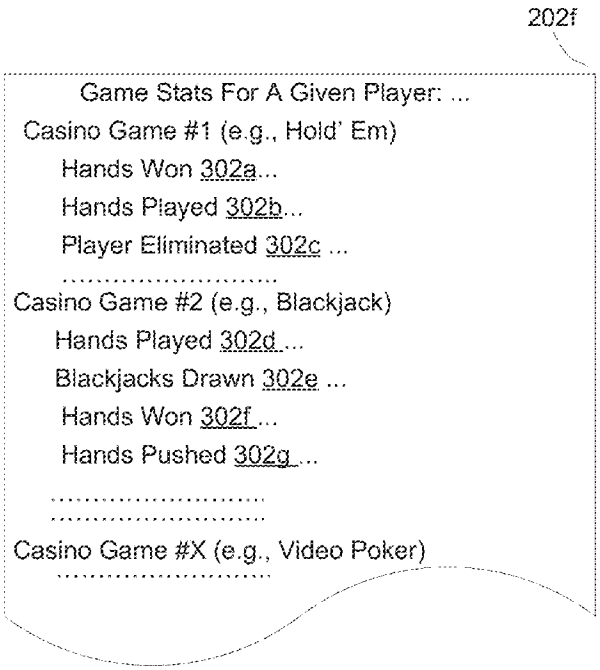
FIG. 3 illustrates an example of the content of game statistics information regarding a player's play in the online casino.

FIG. 3 illustrates an example of the content of game statistics information regarding a player's play in the online casino. It will be referenced with FIG. 2. As shown in FIG. 3, the game statistics information 202*f* included in the player information 202 as illustrated in FIG. 2 may include various statistics regarding play by the given player in the online casino. As can be seen from FIG. 3, the game statistics information 202*f* for the given player may be divided into different categories corresponding to the player's play in the casino-style games. As shown, statistics about the given player's play in a first casino-style game, e.g., Hold'Em, may be included in the statistics information 202*f* to indicate various illustrated examples of play statistics about the given player's play in the first casino-style game. As also shown, statistics about the given player's play in a second casino-style game, e.g., Blackjack, may be included in the game statistics information 202*f* to indicate various illustrated exemplary play statistics about the given player's play in the second casino-style game. As can be seen from FIG. 3, statistics regarding multiple casino-style games played by the given player in the online casino may be included in the game statistics information 202*f*.

Figure 4:
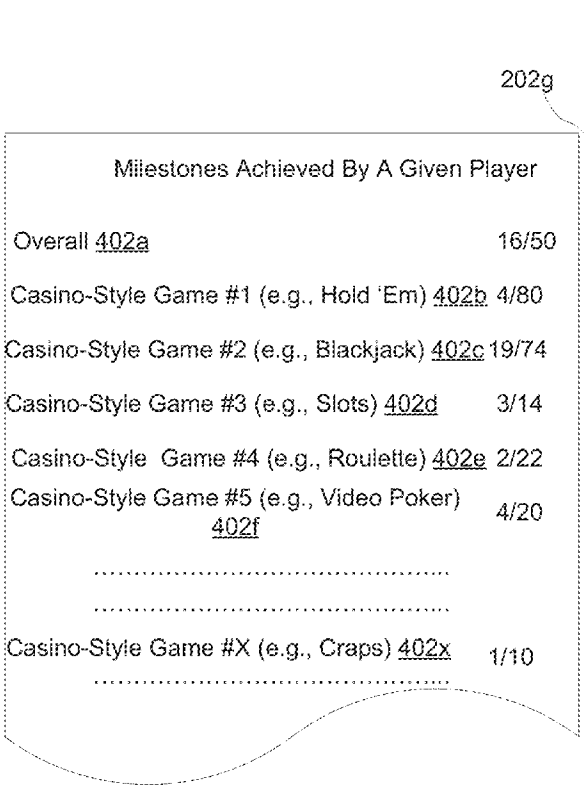
FIG. 4 illustrates one example of milestone information indicating progress by a player in the online casino.

Returning to FIG. 2, milestone information 202*g* may indicate progress made by a given player in the online casino by conveying one or more milestones achieved by the given player in the online casino. FIGS. 4-7 illustrate examples of milestone information 202*g* regarding milestones achieved by a given player in the online game. They will be described with reference to FIG. 2. FIG. 4 illustrates one example of milestone information 202*g* indicating a number of milestones achieved by a given player in the online casino. As shown in FIG. 4, milestone information 202*g* may indicate a number of milestones established by provider, administrator, moderator, and/or any other entities related to the online casino. As shown, the milestones may correspond to individual casino-style games provided in the online casino and/or correspond to the online casino in general. As illustrated in FIG. 4, progress made by the given player may be reflected by a number of milestones completed by the given player in terms of total milestones established for the individual casino-style games and the overall online casino. As shown in this example, the given player has completed 16 out of 50 overall milestones in the online casino; 4 out of 80 milestones in the first casino-style game (e.g., Hold'Em); 19 out of 74 milestones in the second casino-style game (e.g., Blackjack); 3 out of 14 milestones in the third casino-style game (e.g., Slots); 2 out of 22 milestones in the fourth casino-style game (e.g., Roulette); 4 out of 20 milestones in the fifth casino-style game (e.g., Video Poker); 1 out of 10 milestones in the xth casino-style game (e.g., Craps); and/or any other number of milestones for any other casino-style games provided in the online casino. It should be understood the examples of milestones provided above are not intended to be limiting. It is contemplated that milestones in the online casino may include other metrics. For example, the milestones may include metrics measuring a level of user interaction with the performance video content as facilitated by the content interaction component 136 described below. Other examples are contemplated.

Figure 5:
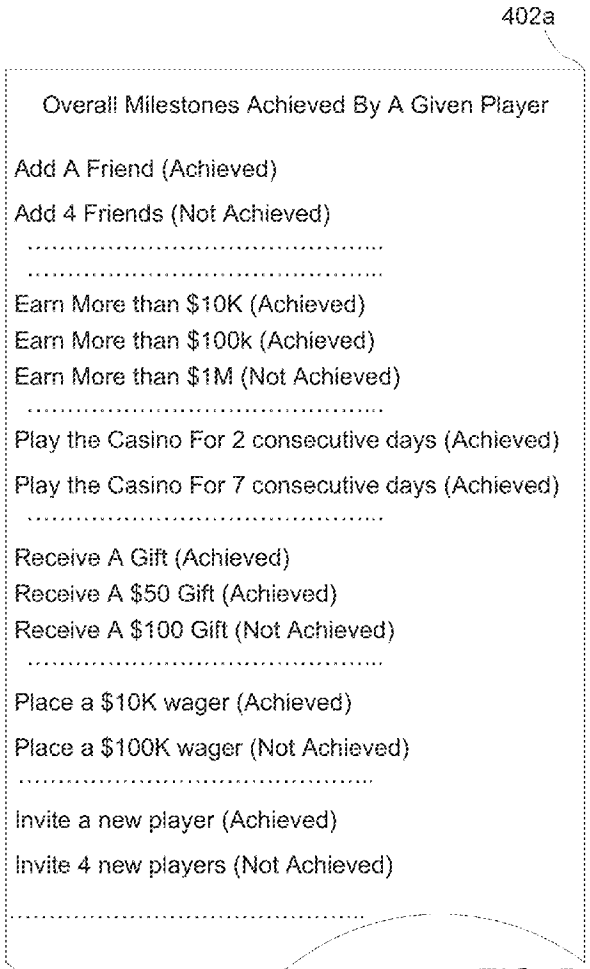
FIG. 5 illustrates an example of the content of the milestone information shown in FIG. 4.

FIG. 5 illustrates an example of the content of the milestone information shown in FIG. 4. It will be described with reference to FIG. 4. As illustrated in this example, the information 402*a* shown in FIG. 4 may indicate a number of milestones achieved by the given player in the online casino in general. As illustrated, such overall general milestones may include milestones reflecting a number of friends added, an amount of earnings, a period of consecutive play in the online casino, an amount of gifts received, an amount of wager placed by the player, a number of new players invited by the given player and/or any other overall milestones achieved by the given player in the online casino.

FIG. 6 illustrates another example of the content of the milestone information 202*g* shown in FIG. 4. It will be described with reference to FIG. 4. As shown, milestones achieved by the players as indicated by the information 402*b* shown in FIG. 4 may include various in-game events achieved by the given player in the first casino-style game, e.g., Hold'Em. As illustrated, such in-game events may include a number of hands won, a number of hands won after all in, wins on particular hands, a number of opponents eliminated (e.g., by reducing their chip balance to zero), a number of hands won at high roller's tables by the given player, and/or any other milestones achieved by the given player in the first casino-style game provided in the online casino.

FIG. 7 illustrates yet another example of the content of the milestone information 202*g* shown in FIG. 4. It will be described with reference to FIG. 4. As shown, milestones achieved by the players as indicated by the information 402*c* shown in FIG. 4 may include various in-game events achieved by the given player in the second casino-style game, e.g., Blackjack. As illustrated, such in-game events may include a number of blackjacks drawn, a number of hands pushed, a number of hands won, wins on split hands, wins on doubled down hands, a number of opponents eliminated (e.g., reducing their chip balance to zero), wins on particular hands drawn, a number of hands won at high roller's tables by the given player, and/or any other milestones achieved by the given player in the second casino-style game provided in the online casino.

Returning to FIG. 2, award information 202*h* may indicate progress by the given player in the online game by conveying individual awards, accolades, and/or any other awards achieved by the given player in the online casino. The award(s) may be generally provided to the given player in the online casino or may be provided to the given player specific to a casino-style game played by the given player in the online casino. As an example, a number of awards may be provided to the given player in a blackjack game for achieving various events, sub-objectives, goals, and/or milestones in the blackjack game. For instance, without limitation, the following awards may be provided to the given player: an award for achieving a first blackjack, an award for achieving a blackjack 10 times, an award for achieving a blackjack 100 times, an award for achieving a first blackjack 1000 times, an award for achieving a pushed hand, an award for achieving 50 pushed hands, an award for winning a hand, an award for wining 50 hands, an award for winning 250 hands, an award for winning 1000 hands, an award for splitting a hand and winning both split hands, an award for splitting a hand twice, an award for doubling down in a hand, an award for doubling down after a split and won, an award for playing 5 hands against odds and won, and/or any other types of awards for achieving an event in the blackjack game by the given player.

As another example, the following awards may be provided in a slot game provided by the online casino: an award for wining a slot, an award for winning 100 times, an award for winning 5,000 times, an award for winning 100,000 times, an award for spinning 100 times, an award for spinning 5000 times, an award for spinning 100,000 times, and/or any other types awards for achieving an event in the slot game by the given player. Still as another example, awards may be provided for player social interaction with other players in the online casino. For instance, an award may be provided to a player after the player has sent a virtual gift to another player in the online casino, has accepted a friend request from another player, has chatted with another player, has participated in a group play in the online casino, and/or any other consideration.

As shown in FIG. 2, the player information 202 in a given player's account may include information 202*h* and 202*i* indicating a number of virtual gifts given to other players or friends in the online casino, a number of virtual gifts received by the given player from other players, a number of friends connected and/or invited by the given player in the online casino, and/or any other statistics related to social activities by the given player in the online game. For example, without limitation, the information 202*i* information may specify individual gifts received by the given player by identifying the gifts, time of receipt, senders of the gifts, location of the gifts sent (e.g., in a blackjack game), and/or any other types of statistics regarding gifts received by a given player. This information may indicate progress made by the given player in the progress as they may reflect the given player's advancement or progression with respect to social interaction with other players in the online casino.

It should be understood that the above described player information 202 indicating progress by the given player in the online casino is illustrative and thus is not intended to be limiting. Other examples of player information 202 may include more or less information than that shown in FIG. 2 to indicate progress made by a given player in the online casino. Other examples of player information indicating progress made by the given player in the online casino are contemplated. For example, in one implementation, the player information in the given player's account may include information indicating one or more virtual items acquired by the given player in the online casino. In another example, the player information in the given player's account may include information indicating one or more gaming tutorials reviewed by the given player.

Returning to FIG. 1, the performance video content component 116 may be configured to manage one or more sets of performance video content for the online casino. A given set of performance video content managed by the performance video content component 116 may contain performance by one or more performers. Examples of performance in the given set of performance video content may include, without limitation, a talk show, a concert, a comedy, a musical show, a magic show, an educational show, a dance show, and/or any other types of performance. The performance in the given set of performance video content may be live or near-live such that the performance takes place simultaneously in real-time with the streaming of the performance in the online casino. The performance in the given set of performance video content may be recorded such that the performance in the given set of performance video content takes place prior to the streaming of the performance in the online casino. For instance, as an illustration, performance of a comedy may be recorded or streamed live in a studio; the recording or the stream may be digitized into a suitable media format such as MPEG-4 and stored in the electronic storage 110 for management by the performance video content component 116.

Managing the one or more sets of performance video content by the performance video content component 116 may involve adding/modifying attribute information, captioning, categorizing, archiving, tagging, storing, automatically deleting, sorting, and/or any other type of operations for managing the set(s) of performance video content. As illustrated above, the set(s) of performance video content may be stored in a network location and/or stored in electronic storage included in server 102, such as the electronic storage 110. In some examples, some or all of the set(s) of video content managed by the performance video content component 116 may be from the external resources 106 shown in FIG. 1. For instance, the external resources 106 may include the database of a third-party content provider that provides performance video content for the online casino. It is contemplated the performance video content managed by the performance video content component may include video contents originally created for purposes other than for display in the online casino. For example, the performance video content may include content available on a social video sharing website that was originally created and shared by a user for his/her own purpose. Such content may be acquired by the online casino and managed by the performance video content component 116.

In some implementations, managing the sets of video content by the performance video content component 116 may include facilitating video content creation on demand, and/or any other types of on-demand requests for altering the sets of the video content managed by the performance video content component. By way of non-limiting example, the performance video content component 116 may be configured to receive a request from a user to create an educational show provided by the online casino—for instance to create a show about a topic. In that example, the performance video content component 116 may effectuate creation of the educational show, for example by generating a notification to staff associated with the online casino or instructing a video editing component in server 102 (not depicted) to perform the requested show creation automatically.

In some implementations, managing the sets of video content by the performance video content component 116 may include managing edited versions of the video content and facilitate player access to the edited versions of the video contention in the online casino. For example, without limitation, an edited version (e.g., highlights, preview, director commentary, and/or any other types of edited version) of the show may be managed in associated with the video content containing the show. Access to the edited version of the show may be provided to the players within the online casino in those implementations.

In some implementations, the provider(s) of the online casino may maintain the performance video content on its own. By way of non-limiting example, the provider(s) of the online casino may arrange performance by performer(s) live streamed to the players. For instance, the provider(s) of the online casino may employ a studio to feed a live performance of a performer in the studio to a streaming-cast server (not depicted). The streaming-cast server (e.g., a web-cast server) may be configured to broadcast the performance to client computing platforms 104 associated with multiple players of the online casino. However, this is not necessarily the only case. In another implementation, the online casino may arrange individual performers to perform at locations of their choice. For instance, an individual performer may be provided equipment such as video cameras, lighting devices, and/or any other devices that can be set up in a room where the performer may perform his/her shows. In that implementation, the performance by the performer may be captured and transmitted from a client computing platform associated with the performer to a webcast server and broadcast to the client computing platforms 104 associated with multiple players of the online casino. Other examples of performance methods are contemplated.

The set(s) of performance video content managed by the performance video content component 116 may include recorded video content. As an example, a given performance by a performer or a group of performers may be recorded and stored for later streaming to the players in the online casino. The recorded performance video content may be stored in a network location and/or electronic storage coupled to server 102, such as the electronic storage 110. As will be described below, the recorded performance video content may be provided to the players of the online casino as video on demand such that upon a player request, the requested performance video content (recorded) may be streamed to the client computing platform 104 associated with that player. In some implementations, the recorded performance video content may be streamed to the players without their requests. For instance, a set of recorded performance video content may be streamed to the players within the online casino as if the performance in the set of recorded performance video content was taking place live.

The access management component 118 may be configured to provide the players of the online casino access to the performance video content managed by the performance video content component 116. Accessing the performance video content by a given player in the online casino may involve viewing the performance video content while placing wagers in casino game(s) by the given player. As will be described in connection with the interface component 120, the given player may be facilitated to view the performance video content in a casino interface while engaging in a casino game through a casino interface. In other example, the given player may be facilitated to view the performance video content in a viewer interface while engaging in a casino game through a casino interface. The access by the given player to the performance video content may be managed by the access management component 118 based on progress made by the given player in the online casino as reflected by the player information in the given player's account managed by player component 114. For incentivizing players to engage the online casino, access to the performance video content may be differentiated based on player progress in the online casino. For example, without limitation, different levels of access may be provided to the players based on their historical purchases and/or current balances of virtual items, currencies, chips, gifts, tickets and/or any other objects in the online casino. As another example, without limitation, different levels of access to the performance video content may be provided to the players based on their levels of experience in the online casino achieved through play in the casino by the players. Still as another example, without limitation, different levels of access to the performance video content may be provided to the players based on milestones achieved by the players in the online casino through play in the online casino. Yet as another example, without limitation, different levels of access to the performance video content may be provided to the players based on their membership in a membership program associated with the online casino. For instance, a loyalty program may be associated with online game such that a given member in the loyalty program may be associated with a level of loyalty reflecting commitment of the given player to the online casino. In that instance, a higher level of access to the performance video content may be provided to members in the loyalty program with higher loyalty levels compared to that of those members with lower loyalty levels as reflected by their membership in the loyalty program.

Providing players differentiated access to the performance video content by the access management component 118 may involve examining player information managed by the player component 114 to determine progress made by the players in the online casino. Some player information may readily indicate progress of the players in the online casino. For example, as described above, player information in a given player's account may readily indicate a level of a player's experience in the online casino, such as, without limitation, a level 5 player, a level 8 player, a level 10 player and the like. In that example, differentiated access to the performance video content may be provided based on such level information regarding the players. For instance, without limitation, a first level of access to the performance video content may be provided to a level 3 player while a second level of access (higher than the first level of access) may be provided to a level 5 player.

In some examples, the progress of a given player in the online casino as reflected by the player information in the given player's account may not be readily employed by the access management component 118 to provide the differentiated access to the performance video content. In those examples, the access management component 118 may be configured to analyze the player information in the given player's account and determine a level of access for the given player based on a result of the analysis. For instance, without limitation, the player information in the given player's account may indicate the given player has achieved a number of milestones in a given casino game provided by the online casino. In that instance, the access management component 118 may acquire player information regarding the given player and determine a level of access to the performance video content based on analysis of the player information. In some implementations, the analysis may be performed by the access management component 118 dynamically. By way of non-limiting example, in one implementation, such an analysis may be performed by the access management component 118 at the request of personnel of the online casino through an interface of the server 102. In that implementation, analytical information may be provided by the personnel for performing the analysis by the access management component 118. As an illustration, in one example, the personnel may request the server 102, via access management component 118, to provide access to a set of performance video content (e.g., a live streaming performance of a comedy) to players who have placed more than $100k chips as wagers in their current sessions in the online casino. In that example, the access management component 118 may acquire player information of the players who are currently engaging in the online casino and determine a list of players who have placed more than $100k chips in their current sessions in the online casino. In some other implementations, the analysis performed by the access management component 118 may be based on configuration file predetermined by the provider, administrator, moderator, and/or any other entities related to the online casino. For example, without limitation, an association of a number of specific milestones achieved by a given players and a level of access to performance video content may be predetermined by the provider(s) of the online casino. In that example, the access management component 118 may determine a level of access to the performance video content for a given player based on such associations.

Figure 8:
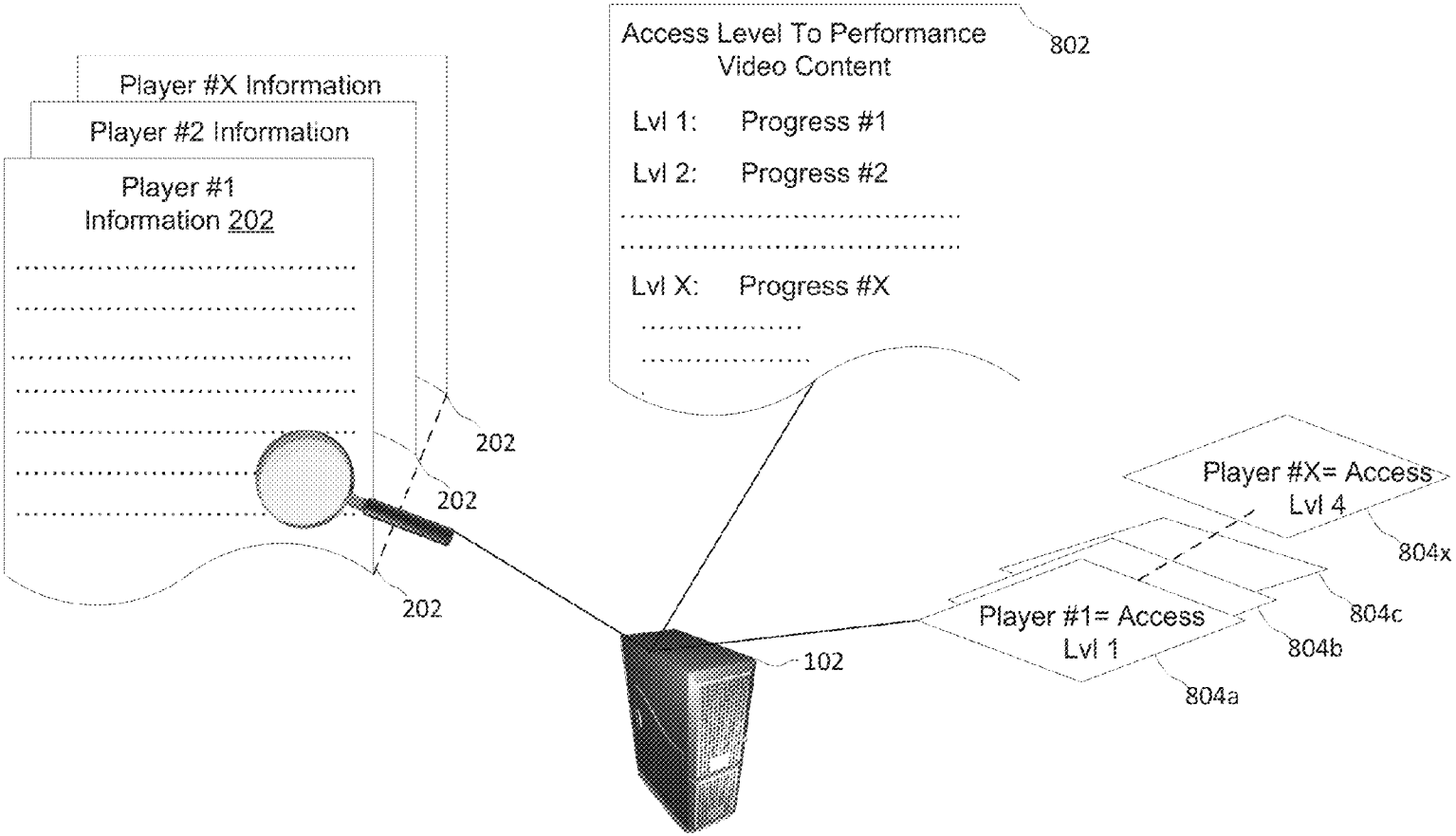
FIG. 8 illustrates one example of determining levels of access to performance video content based on player progress in the online casino.

FIG. 8 illustrates one example of determining levels of access to performance video content based on player information. It will be described with reference to FIGS. 1-2. As illustrated, server 102, e.g., via the access management component 118, may acquire player information 202 regarding individual players in the online casino. As also illustrated, server 102 may examine the player information to determine a progress in the online casino by a given player, such as player #1 shown in this example. As discussed above, some of the player information 202 regarding the given player may readily reflect the given player's progress in the online casino; and some other player information may be analyzed for determining the given player's progress. As shown in this example, associations 802 may specify one or more associations between a level of access to the performance video content and corresponding progress in the online casino required of a player. As shown, based on the determined player's progress and the associations 802, determinations 804 of levels of access to the performance video content for the individual players of the online casino may be made.

Returning to FIG. 1, a number of aspects of access to the performance video content may be differentiated based on player progress in the online casino. For example, without limitation, in one implementation, the access may be differentiated with respect to streaming quality of the performance video content when presented to the players in the online casino. For instance, a lower streaming quality, e.g., 128 kb/sec, may be provided to players with less progress in the online casino while a higher streaming quality, e.g., 512 kb/sec, may be provided to players with more progress in online casino. As another example, lower video resolution, e.g., 360P, may be provided to players with less progress in the online casino, and higher video resolution, e.g., 720P, may be provided to players with more progress in the online casino. In another example, fewer video controls (e.g., only volume control and brightness adjustment) may be provided to players with less progress in the online casino while more video controls (e.g., volume, brightness, contrast, surround sound, size, and/or any other video controls) may be provided to players with more progress in the online casino. Differential control aspects of performance video content access, such as, pause, reply, rewind, annotate, edit, share, save and/or any other aspects, are contemplated. For example, without limitation, a player may be enabled to share performance video content just watched with another player in the online casino after the player has reached a certain level in the online casino.

In some implementations, access to the performance video content may be differentiated with respect to availability of the performance video content. For example, less performance video content may be provided to players with less progress in the online casino compared with players with more progress in the online casino. For instance, in one implementation, a premium comedy show performed by popular comedian performers may be provided only to players having certain progress or above in the online casino (e.g., only provided to level 10 and above players). In some implementations, the differentiated access may be by the type of performance video content available to the players based on their progress in the online casino. For example, without limitation, live or near-live performance video content may be provided only to those players having more than a $500K chip balance, and players with less than a $500K chip balance may only be provided delayed or recorded performance video content. As another non-limiting example, special performance video content such as exclusive behind scene access to a popular performance, extras to a performance (e.g., director narrative to a musical, background stories about a comedy show and/or any other types of extras), comic entertainment performance and/or any other type of special performance video content may be provided only to players who have achieved certain progress (e.g., level 5 or above players) in the online casino. As still another example, highlights, quick run-down, special commentary version, and/or any another edited version of the performance video content may be provided only to players who have achieved certain progress in the online casino.

In some implementations, the differentiated access to the performance video content provided by the access management component 118 may be based on access period. For example, without limitation, access to the performance video content may be made available for longer periods of time to players with more progress in the online casino than those with less progress. As an illustration, certain performance video content may be available to a level 10 player for access within 3 months after the performance video content is first available (e.g., streamed) in the online casino, while the same performance video content may only be available to a level 5 player for access within 1 month after the performance video content is first available in the online casino.

In some implementations, the differentiated access to the performance video content provided by the access management component 118 may be based on available methods of accessing. For example, without limitation, the performance video content may be provided for access as video on demand (VOD) upon player's requests. In that example, a search feature of a VOD library may be provided to players only after the players have achieved certain progress desired by the provider(s) of the online casino. For instance, after a player reaches 500 wins in casino-style games within the online casino, the search capability may be made available to the player such that the player may search for a particular set of performance video content for viewing. In another non-limiting example, indexes of performance video content in the VOD library may be provided to players only after they achieve certain progress in the online casino. For instance, the VOD library may become browse-able by performance type, by date of first available/streamed in the online casino, and/or by any other types of indexes only after the player has invited 5 friends to join the online casino. Still as another example, longer period of VOD may be provided to players with more progress in the online casino than those with less progress in the online casino. For instance, players with at least $100K accumulative winnings in the online casino may be provided a VOD library with past one year performance video content, while players with $50K-$100K accumulative winnings in the online casino are provided past 3 month performance video content, and players with less than $50K accumulative winnings in the online casino may not be provided a VOD library.

In some implementations, the differentiated access to the performance video content as provided by the access management component 118 may be as a type of payout of a casino-style game. For example, without limitation, streaming quality of the performance video content may be based on a level of player's experience in the online casino as described above. In that example, the streaming quality may be improved for a period of time upon a player achieves a certain win in the online casino. For instance, as an illustration, a level 5 player may be provided 128 Kb/sec streaming quality of the performance video content by virtue of having achieved level 5 in the online casino, and upon the level 5 player wins a hand of blackjack against odds, the streaming quality may be improved to 256 Kb/sec for one hour viewing of the performance video content by the level 5 player. As another illustration, a level 10 player may be provided 512 Kb/sec streaming quality by virtue of having achieved level 10 in the online casino, and upon the level 10 player has achieved a win in Hold'Em on 10-9 hole cards, the streaming quality may be improved to 1028 Kb/sec for viewing 30 minutes of performance video content by the level 10 player. As described above, such improved access to the performance video content may be as a part of payout scheme for the casino-style game.

In some implementations, the differentiated access to the performance video content as provided by the access management component 118 may be based on tickets spent by the players within the casino, virtual currency paid by the players, and/or any other consideration. As described below, the online casino may provide tickets to players for purchase or as awards. The tickets may be used by the players to improve access to the performance video content. For example, without limitation, a player may be enabled to spend 10 tickets to improve streaming quality of the player's access to the performance video content in the online casino for one hour of viewing; may spend 50 tickets to access the VOD library where past performance video content is archived; may spend 100 tickets to view a live performance video content that the player otherwise does not have access to because the player has not achieved the required progress in the online casino; or any other ways to improve access to the performance video content by spending tickets. However, this is not intended to be limiting. The mechanism described herein by which differentiated access to the performance video content may be purchased or granted through tickets may also be purchased or granted through virtual currency usable in the online casino.

The interface component 120 may be configured to provide one or more casino interfaces for presentation on client computing platforms 104. Providing a given casino interface by the interface component 120 may involve determining view information regarding a view of online casino. The view information may reflect a view of the online casino from a player's perspective. In some implementations, the online casino may include various rooms, sections, halls, and/or any other types of partitions to mimic a real-life casino. In those implementations, the players may play casino-style games in the individual partitions. For example, without limitation, in one implementation, players may join individual rooms within the online casino to play casino-style games held in those rooms. In that example, the view information may be determined by individual players in the room from vintage points of those players. For instance, a top view of a casino table, a front face view of a slot machine, an angled side view of a board, and/or any other type of views may be included in the view information. As discussed above, in some implementations, multiple players and/or casino devices (e.g., slot machines, casino tables, roulette rollers, and/or any other types of casino devices) may be included in the view information for presentation on a client computing platform 104.

The view information may be employed by the interface component 120 for providing a casino interface to a given player on the client computing platform 104 associated with the given player. The casino interface provided by the interface component 120 may include controls that allow the given player to place wagers, call, spin, wave off a card, and/or initiate any other types of actions for playing a casino-style game. The casino interface may include an area where performance video content may be presented to the player. In some implementations, a virtual stage may be included in the casino interface such that the performance video content may be accessed by the players through the virtual stage. In some implementations, a virtual theater may be embedded in the casino interface such that the player may view the performance video content through the virtual theater. In implementations, an embedded media player, such as Flash™ player may be employed in the casino interface to simulate the streaming portion of the virtual stage or virtual theater.

Figure 10:
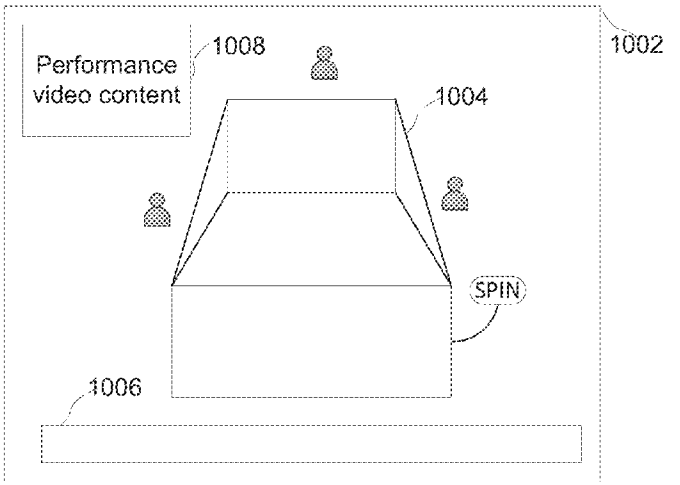
FIG. 10 illustrates another example of a casino interface through which performance video content may be accessed.
Figure 9:
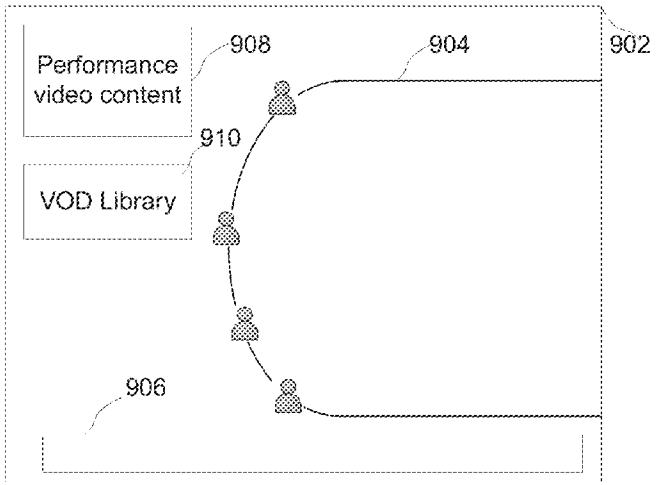
FIG. 9 illustrates one example of a casino interface through which performance video content may be accessed.

By way of illustration, FIGS. 9 and 10 depict examples of casino interface configured to facilitate players to access performance video content while placing wager in a casino-style game provided in the online casino. The casino interface may be provided by a system 100 similar to or the same as system 100 (shown in FIG. 1 and described herein). FIG. 9 illustrates one example of a casino interface 902 wherein a given player may be enabled to play a casino-style game (e.g., Blackjack, Poker) through a casino table 904. FIG. 10 illustrates one example a casino interface 1002 wherein a given player may be enabled to play a casino-style game through slot machines 1004. As can be seen from FIGS. 9 and 10, the casino interface may enable the given player to view other play actions by other players in the casino-style game. This may enable multiplayer feature as shown in FIG. 9 and/or may provide the player a sense of social environment as shown in FIG. 10. As also can be seen from FIGS. 9 and 10, field controls 906 and 1006 may be provided in the casino interface to enable players to initiate casino actions to play the casino-style game. The enabled casino actions may include placing a wager (e.g., bet), adjusting an amount of wager to be placed, selecting a number of lines to be played, and/or any other casino actions for playing the casino-style game facilitated by the casino interface. As shown in FIGS. 9 and 10, a virtual stage 908 and 1008 respectively may be provided in the casino interface for presenting performance video content (described herein). As described above and herein, various aspects of access to the performance video content, such as streaming quality, video resolution, available controls, type of content available and/or any other aspects of the access may be differentiated based on player's progress in the online casino. The differentiated access may be reflected in the presentation of the performance video content through the virtual stage as illustrated in the casino interface in FIGS. 9 and 10. Through the virtual stage, the players may be enabled to view the same performance video content simultaneously (or near simultaneously), view different performance video content on demand at different times, and/or any other viewing experiences. In some implementation, as shown in FIG. 9, a VOD library described above and herein may be made available to the player in the casino interface 902 such that the player may request past performance video content on demand for viewing through the virtual stage 908. In those implementations, the differentiated access to the performance video content may be reflected by various differentiated features available to the player through the VOD library described above and herein, such as search capability, content scope of the VOD library, indexing features and/or any other VOD features. It should be understood that the layout of the interfaces shown in FIG. 9 and FIG. 10 is merely illustrative. The positions of the display of the performance video content, the field controls and other components illustrated in FIGS. 9-10 may vary in other implementations. For example, in one implementation, the virtual stage may be position in the middle of the interface 900 surrounded by the gaming components (e.g., field controls 906, casino table/machine 904). Other examples of the layouts of a casino interface having a performance video content display are contemplated.

In some implementations, one or more sections of the online casino may be associated with a virtual stage or theater such that the stage or theater may be viewed from a corresponding angle from a given section of the online casino. For example, without limitation, a virtual stage may be associated with a casino hall in the online casino. The virtual stage may be centered in the casino hall where multiple casino tables and/or slot machines are placed. A given casino interface presented on a client computing platform 104 may reflect a view in the casino hall such that the view reflects the virtual stage from a corresponding angle.

Figure 11B:
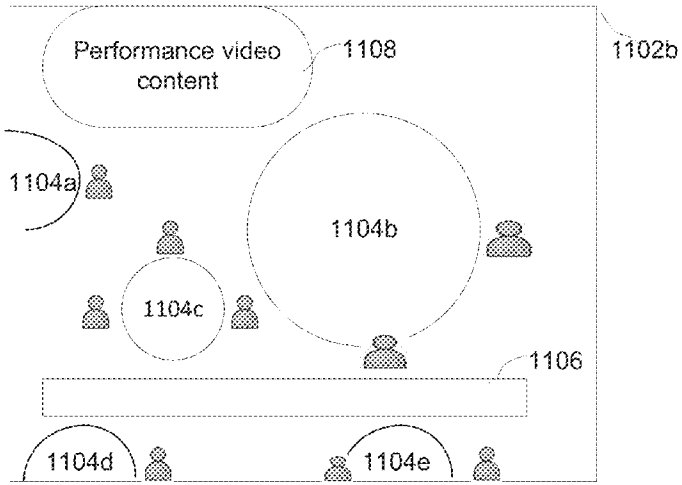
FIG. 11B illustrates another view of the virtual stage shown in FIG. 11A from a perspective of a player playing at casino table different from that in FIG. 11A.
Figure 11A:
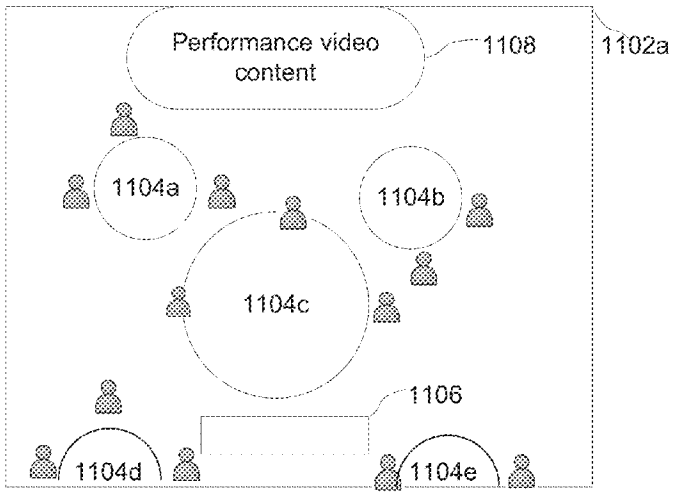
FIG. 11A illustrates a view of a virtual stage that presents the performance video content in the online casino from a perspective of the player playing at a specific casino table.

By way of illustration, FIGS. 11A and 11B illustrate a casino interface having a virtual stage viewed from a corresponding angle from a perspective of a player. The casino interface 1102 depicted in FIGS. 11A and 11B may be generated and/or provided by a system similar to or the same as system 100 (shown in FIG. 1 and describe herein). In FIG. 11A, the casino interface 1102*a* illustrates a view of the online casino from a perspective of a player playing at table 1104*c*. In FIG. 11B, the casino interface 1102*b* illustrates a view of the online casino from a perspective of player at table 1104*b*. As can be seen in FIGS. 11A and 11B, the casino interface 1102 may present multiple views of multiple casino tables 1104 to reflect an environment that mimics a section of a real-life casino. As also can be seen in FIGS. 11A and 11B, field controls 1106 may be provided in the casino interface 1102 to facilitate players to initiate casino actions to play a casino-style game. As can be seen in FIGS. 11A and 11B, the interfaces 1102 may reflect a view of a virtual stage 1108 from corresponding angles from the player's perspective. As illustrated, the view of the virtual stage 1108 in interface 1102*a* may be a 90 degree front view because it is viewed from the perspective of the player at table 1104*c*; and the view of the virtual stage 1108 in interface 1102*b* may be from an acute angle because it is viewed from the perspective of the player at table 1104*b*.

Returning to FIG. 1, the ticket component 122 may be configured to facilitate tickets for use by players within the online casino. Ticket use within the online casino may be facilitated by the ticket component 122 in a number of ways. For example, tickets may be used to exchange chips, to engage in certain casino-style game(s) (e.g., pay with tickets to play), to exchange for one or more rewards, to improve access to the performance video content, and/or for any other purposes. Facilitating tickets for use in the online casino by the ticket component 122 may involve issuing, distributing, managing, accounting tickets for individual players in the online casino, and/or any other operations. In some implementations, the tickets may be "earned" by the players through play in the online casino. For example, without limitation, tickets may be awarded to players as a type of payout of one or more casino-style games provided in the online casino. In another non-limiting example, tickets may be awarded to players as the players progress in the online casino (e.g., reaching certain level of experience, achieving certain milestones, and/or achieving any other types of progress). In some implementations, tickets may be purchased by players in the online casino. For example, without limitation, tickets may be purchased by the players using real-world money credit, virtual currency, credit usable in the online casino, and/or any other types of exchange means desired by the provider, administrator, moderator, and/or any other entities related to the online casino. Tickets acquired by the players in the online casino may be distributed to player accounts managed by the player component 114. Ticket balance may be managed for individual players as they acquire or spend tickets in the online casino.

Tickets acquired by a given player in the online casino may be spent by the player for acquiring and/or improving access to performance video content within the online casino. For example, without limitation, live performance video content (e.g., a live talk show) may be provided in the online casino to the players in exchange for tickets. For instance, a given player may spend certain amount of tickets (e.g., 50 tickets) to acquire access to the live performance video content in advance of or during the streaming of the live performance video content in the online casino. Responsive to the given player spending the tickets for accessing the live performance video content, the live performance video content may be automatically presented in the casino interface, such as the casino interfaces 902, 1002, 1102 illustrated in FIGS. 9, 10 and 11 respectively, according to the schedule of the live performance. As an illustration, the given player may use tickets to purchase access to a live comedy show scheduled to be live streamed in the online casino at 9 pm the next day. Once the access is purchased by the given player, the live comedy show may be presented to the given player in a virtual stage in a casino interface at 9 pm the next day. In another example, the given player may be enabled to use tickets to purchase access to performance video content on demand, such that once the access is purchased with tickets by the given player, the requested performance video content may be presented to the given player through the casino interface.

In some implementations, tickets may be spent by the given player to improve access to the performance video content. For example, without limitation, the given player may be enabled to spend tickets to improve streaming quality, video resolution, available controls, type of performance video content available for access, and/or any other aspects of the performance video content temporarily or permanently. In another example, the player may spend tickets to acquire various features of a VOD library available to the player, such as, but not limited to, improved search filters, tags for browsing, indexes, prolonged access period, and/or any other types of VOD features.

The chat component 124 may be configured to implement chat sessions to facilitate synchronous textual communications between players within the online casino. The textual communications may include one or more of textual chat, instant messages, private messages, and/or other communications. The textual communications may facilitate the players to engage in social interactions, recruit other players, invite other players to cooperate, and/or engage in any other activities enabled by the textual communications within other online casino. The textual communications may be received and entered by the players via their respective client computing platforms 104 and may be routed to and from the appropriate other players through server 102 via a chat session implemented by the chat component 110. A chat session may include complete textual communication inputs from players who have participated in the chat session. The textual communication inputs in a chat session may be stored on and accessed from the electronic storage 110. In some examples, a chat session may be open ended within the online casino such that it does not finish until a provider, administrator, moderator, and/or any other entities related to the online casino decides not to provide the chat session through the chat component 124. In some other examples, a chat session may be initiated and stopped by the players at any time as desired.

The chat component 124 may be configured to provide chat interfaces to facilitate presentation of textual communications between the players of online casino and/or communications between the players and performer(s) of performance video content. The chat interfaces provided by the chat component 124 may form a part of a given casino interface provided by the interface component 120. For example, a chat interface may be embedded in the casino interfaces 902, 1002, 1102 to facilitate the players of a casino-style game provided within the online casino to chat. The chat interface may facilitate the players to interact with performer(s) of performance video content presented to the players while playing the casino-style game through the casino interface. For example, without limitation, a given player may chat with the performer through textual chat to comment on the performances, exchange banter, intimacy, request specific acts to be performed, share a video, share a photo, send a voice, and/or to perform any other types of interactions with the performer through the chart interface. In some implementations, the chat interface may simulate a room within the online casino such that a group of players may exchange communications through the room view chart interface with each other and/or with the performer(s).

Figure 12:
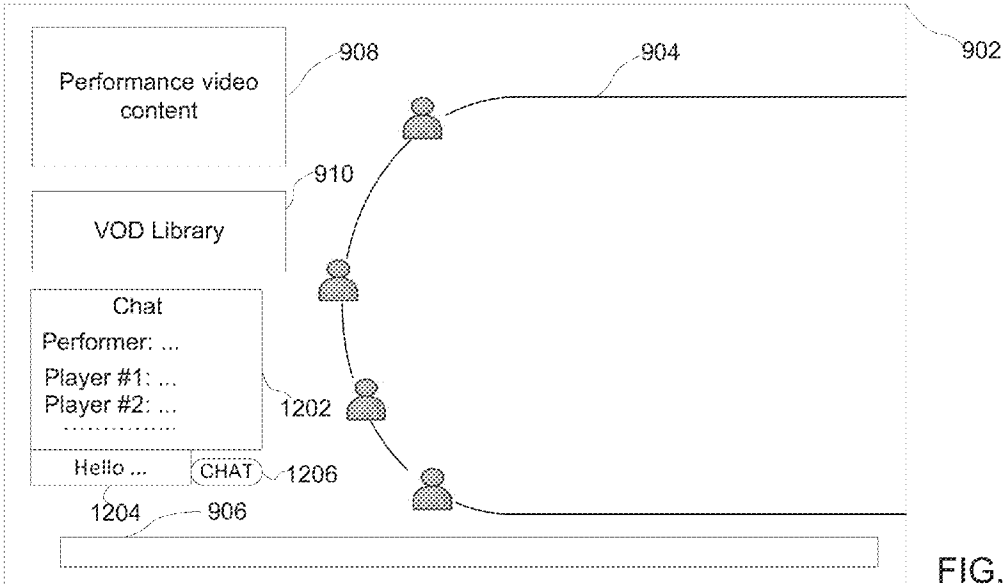
FIG. 12 illustrates one example of a chat interface embedded in the casino interface shown in FIG. 9.

FIG. 12 illustrates one example of a chat interface embedded in the casino interface shown in FIG. 9. It will be described with reference to FIG. 9. As shown, a chat interface 1202 may be provided in the casino interface 902 to facilitate communications between the players of a casino-style game, facilitated by the casino interface 902, and between the players and the performer(s) of the performance video content presented through the virtual stage 908. As can also be seen in FIG. 12, an input receipt box 1204, a chat button 1206 and/or any other types of field controls may be provided in the casino interface to facilitate the communications between the players and communications between the players and the performer(s).

The schedule component 126 may be configured to provide schedules of multiple sets of performance video content available for access by players in the online casino. Providing the schedules by the schedule component 126 may involve receiving information indicating dates and/or time when the multiple sets of performance video content are available for access in the online casino. For example, without limitation, schedule component 126 may receive such information from the provider, administrator, moderator, and/or any other entities related to the online casino. In some implementations, individual performers may be enabled to provide their schedule of performance from client computing platforms 104 associated with the individual performers.

Figure 13:
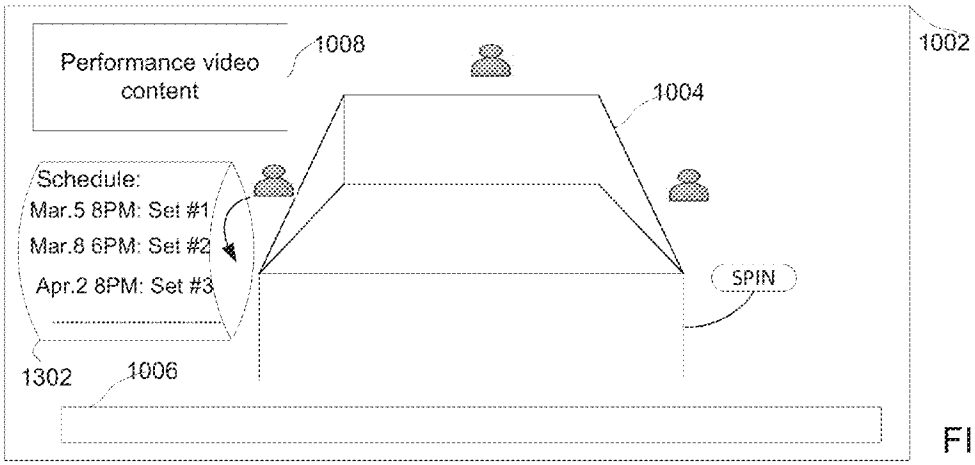
FIG. 13 illustrates one example of providing a schedule regarding multiple sets of performance video content in the casino interface shown in FIG. 10.

The schedule component 126 may be configured to generate graphical information for presenting, through the casino interfaces, the schedule of the multiple sets of the performance video content to the players. In some implementations, the schedule may be presented in the casino interfaces such as the casino interface 902, 1002, 1102 illustrated in FIGS. 9, 10 and 11A-B respectively. FIG. 13 illustrates one example of providing a schedule regarding multiple sets of performance video content in the casino interface 1002 shown in FIG. 10. It will be referenced with FIG. 10. As illustrated in FIG. 13, a schedule of multiple sets of performance video content that will be streamed in the online casino may be presented in the casino interface 1002. As shown, in some implementations as in this example, the schedule 1302 may be presented in the casino interface in a rolling manner such that the presentation of the schedule 1302 may appear to be animated.

In some implementations, the schedule component 126 may be configured to organize the schedules presented to the user based on the casino content, player demographics, the layout of individual games where the schedule is presented, and/or any other factors. By way of non-limiting example, the schedule presented in a blackjack game within the online casino may be different from the schedule presented in a poker game; the schedule presented to a player who logs on the online casino game from China may be different from a player from the US. Other examples are contemplated.

The reservation component 128 may be configured to enable the players of the online casino to register as audience to view the performance video content in a time period when the performance video content is available in the online casino in accordance with the schedule provided by the schedule component 126. That is, the reservation component 128 may be configured to facilitate RSVP functionality for the players to make reservations for viewing performance video content within the online casino. Popular performance video content may require reservations due to various factors, such as agreement with the performer(s), bandwidth limitation, promotional consideration, and/or any other factors. The reservation component 128 may facilitate the players of the online casino to make reservations such that they may be registered as audience that will view the performance video content. In some examples, the reservation component 128 may be configured to provide RSVP options to the players in a prioritized manner based on their progress in the online casino and/or any other consideration. For example, without limitation, during a first period, the RSVP options for reserving a particular set of performance video content may only be available to players having achieved a first level of progress in the online casino (e.g., those with more than $1 M chip balance); during a second period, the RSVP options may be available to the players having achieved a second level of progress in the online casino (e.g., those with more than $100K chip balance); during a third period, the RSVP options may be available to the players having achieved a third level of progress in the online casino (e.g., those with more than $10K chip balance); and/or any other consideration.

Figure 14A:
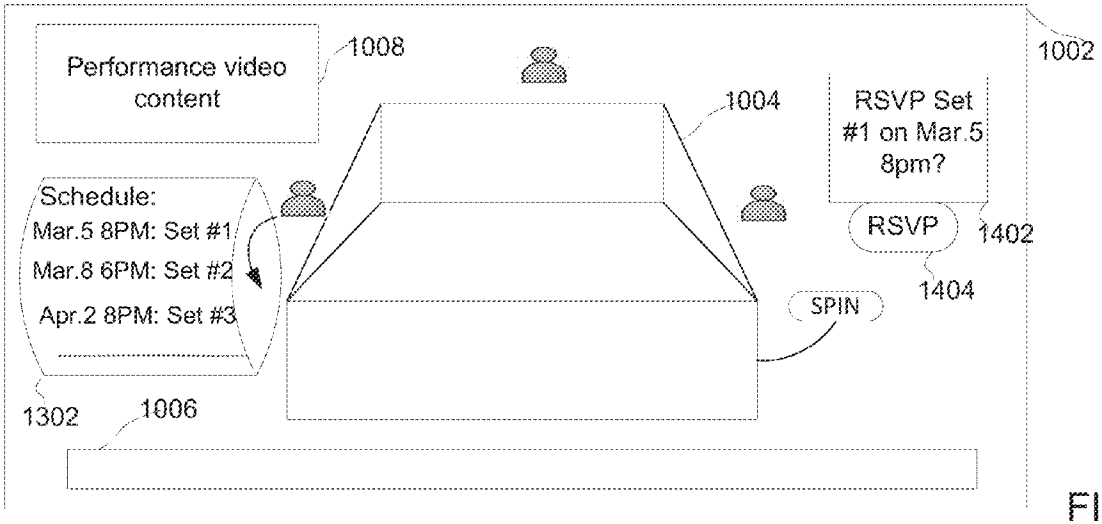
FIG. 14A illustrates one example of facilitating a player to RSVP to a set of performance video content through the casino interface shown in FIG. 10.

FIG. 14A illustrates one example of facilitating a player to RSVP a set of performance video content through the casino interface shown in FIG. 10. It will be described with reference to FIGS. 10 and 11. As shown, an RSVP option 1402 may be presented in the casino interface 1002. As also shown, the RSVP option 1402 may enable the player to make a reservation to view a set of performance video content shown in the schedule 1302. It should be understood, although only one RSVP option 1402 is illustrated in this example, this is not intended to be limiting. In some other examples, multiple RSVP options 1402 may be presented in the casino interface however many desired by the provider, administrator, moderator, and/or any other entities related to the online casino. As still shown in FIG. 14A, a RSVP accept button 1404 may be provided in the casino interface 1002 to facilitate the player to RSVP the set of performance video content presented in the RSVP option 1402.

Figure 14B:
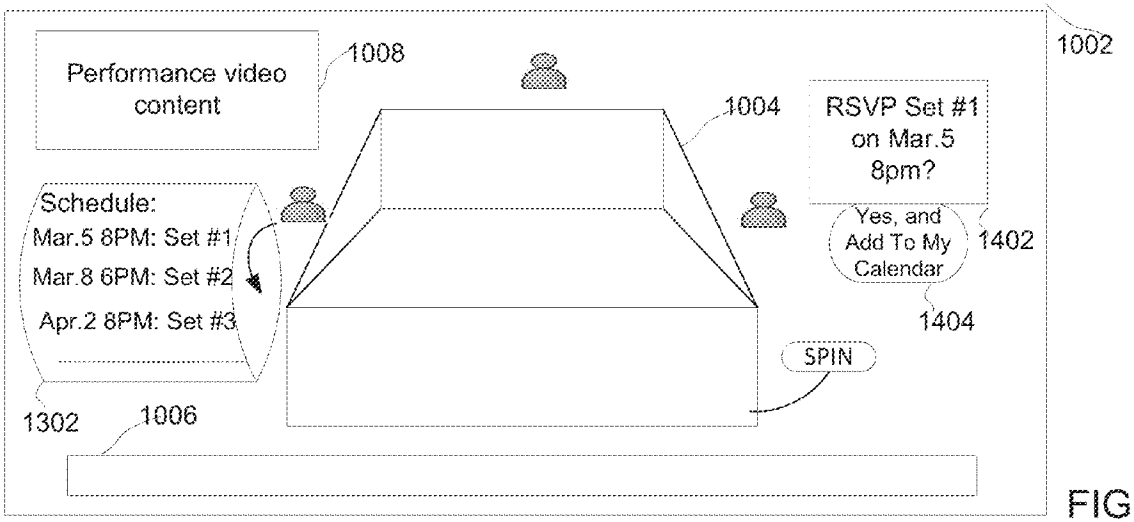
FIG. 14B illustrates an example of facilitating, through the casino interface, a player to incorporate an RSVP date and time for viewing a set of performance video content into the player's calendar.

Returning to FIG. 1, in some implementations, the reservation component 128 may be configured to facilitate the players to incorporate the date and/or time of a reserved set of performance video content into one or more calendars provided by an Internet service provider associated with the players. For example, without limitation, a given player may be facilitated by the player component 114 to link one or more calendars to their account in the online casino. Examples of such calendars may include calendars provided by Facebook™, Google™, Outlook™, Eventribe™, and/or any other Internet service providers. For instance, the given player may link his/her Google calendar to his/her player account in the online casino. The reservation component 128, in those implementations, may be configured to incorporate the date(s) and/or time reserved by the given player for viewing one or more sets of performance video content into the calendar(s) linked by the given player. FIG. 14B illustrates an example of facilitating, through the casino interface, a player to incorporate an RSVP'd date and time for viewing a set of performance video content into the player's calendar. As shown, in this example, the button 1404 may be provided in the casino interface 1002 to facilitate the player to add the RSVP'd date and time to his/her calendar linked to the player's account.

In some implementations, the reservation component 128 may be configured to facilitate a player to reserve a private showing of performance video content for his/her friends. By way of non-limiting example, the reservation component 126 may be configured to receive a request from a user to reserve a private showing the performance video content. The received request may include information indicating one or more other players the requesting player would like to invite to the private showing, the date(s) and time(s) at which the private showing will take place in the online casino, identification of the specific performance video content the requesting player would like to include in the private showing, one or more messages to be sent to the other players for invitation, and/or any other information. After receiving such a request, in that example, the reservation component 128 may generate invitation requests to the other players, instructions to the access component 118 to grant access to the specific performance video content by the player, and/or perform any other operations to facilitate the reservation of the private showing requested.

The notification component 130 may be configured to generate notifications for reminding the players that the players are registered to view sets of performance video content in the online casino during reserved time periods. The notification generated by the notification component 130 may include information for reminding a given player that one or more sets of performance video content reserved by the given player are going to be available in the online casino on the dates and/or time in accordance with the schedule provided by the schedule component 126. For example, without limitation, the notification component 130 may generate a notification to remind the given player that a set of performance video content reserved by the given player will be live streamed in the online casino on the date and time reserved by the given player.

The notification component 130 may be configured to effectuate transmission of the notifications through electronic communication media internal and/or external to online casino. This may include determining one or more of communication media through which the notifications may be transmitted to the corresponding players, and/or other aspects regarding the notifications. Determining the communication media may include selecting one or more communication media (e.g., email, text, instant message, push notification, voice, visual alert and/or other media) for a given notification to the corresponding players. For example, notification component 130 may effectuate transmission of notifications to the given player through a casino interface whenever the given player is interacting with the casino interface in the online casino; and may effectuate the transmission of the notifications to the given player through external medium such as email, instant messages, push notifications, text messages and/or any other external medium when the given player is not interacting with the online casino (e.g., the given player is not logged on or the given player is idle in the online casino for extended period of time). Communication media external to the virtual space may include communication media not relayed to the players by server 102. Instead, such communication may be relayed to the players through an external service provider. As notifications are transmitted to players, records of such transmissions may be made (e.g., in the player's accounts). The records may include information about one or more of a format of the notifications, the content in the notifications, the communication media used to transmit the notifications, and/or other information about the notifications.

The offer component 132 may be configured to provide offers for presentation to the players through the casino interfaces. The offers provided by the offer component 132 may include virtual items, currencies, chips, tickets and/or any other objects usable in the online casino for purchase by the players. Providing such offers may involve presenting the offers in connection with one or more sets of performance video content. For example, without limitation, promotional sale of chips may be held during the streaming of live performance video content in the online casino. For instance, offers of chips with a discount (e.g., 10% discount for purchasing 1000 chips, 15% discount for purchasing 5000 chips, etc.) may be presented in the casino interfaces to the players during streaming of a live comedy show by a popular comedian. As another example, offers of virtual items such as virtual gifts may be presented in the casino interface to the players during a period leading to the streaming of the performance video content. The offered virtual gifts may be used by the players as banter with the performer(s) and/or other players before, during, and/or after the streaming of the performance video content. Examples of such virtual gifts may include virtual rose, drinks, food, apparels, perfume, accessories, decorative items, and/or any other type of virtual gifts. Still as another example, virtual items such as virtual bobble heads, dolls, toys and/or any other items may be offered for purchase by the players after the streaming of performance video content. Those virtual items may be items used or appeared in the performance video content or may be promoted by the performer(s) of the performance video content. Yet as another example, tickets to an after show interaction with the performer(s) of the performance video content may be offered for purchase by the offer component 132 during the streaming of the performance video content in the online casino. Still as another example, merchandise such as exclusive and/or commemorative real-world items (e.g., mugs, t-shirts and/or any other types of real-world items) may be offered for purchase by the offer component 132.

In some implementations, information regarding offers provided by the offer component 132 in connection with the performance video content may be included in notifications generated by the notification component 130 for transmission to the players. For example, without limitation, emails may be transmitted to the players who have not logged into the online casino for extended period of time to notify them that chips are on sale along with streaming of a live performance video content that is under way currently in the online casino. This may incentivize those inactive players to log into the online casino. In another example, push notifications may be sent to the players notifying them that rare virtual gifts are on sale for a limited time such that the rare virtual gifts may be used by the players during an upcoming streaming of performance video content for bantering that will set them apart. Other examples are contemplated.

The invitation component 134 may be configured to facilitate players to invite friends to access the performance video content within the online casino. This may involve receiving inputs from the players indicating one or more friends they would like to invite to the online casino to access the one or more sets of performance video content. The received inputs may include information indicating contact information such as name, email, phone number, social media name, and/or any other types of contact information of the friends. The invitation component 134 may be configured to compose an invitation message addressed to the friends expressing that the players would like to invite them to view performance video content in the online casino. In some implementations, the invitation component 134 may be configured to track whether the friends accept the invitations conveyed by the invitation messages composed by the invitation component 134. For example, tracking code may be embedded in an invitation message to track friends' activities after receiving the invitation message. In some implementations, the invitation component 138 may be configured to receive such a invitation message from the player.

The content interaction component 136 may be configured to facilitate the players to interact with the performance video content. A given player may be facilitated by the content interaction component 136 to interact with performance video content in a number of ways. For example, without limitation, the given player may be enabled to give virtual gifts to the performer(s) of performance video content during streaming of the performance video content in the online casino. In one implementation, this may be achieved through a chat interface such as the chat interface 1202 illustrated in FIG. 12. During the performance of the performance video content by the performer(s), the given player may be enabled by the content interaction component 136 to give virtual gifts to the performer(s) as banters through the chat interface. In another implementation, individual gift buttons may be provided in the casino interface by the content interaction component 136 to facilitate gift giving by the players to the performer(s).

In some examples, the content interaction component 136 may be configured to enable the given player to participate in the performance of performance video content. For example, without limitation, the given player may be enabled to sing along with the performer in the performance. In another example, the given player may be enabled to participate in a talk show, learning show, comedy show, and/or any other shows streamed in the online casino. For instance, the given player may be given voice communication connection with a talk show host as a call-in guest.

In some examples, the content interaction component 136 may be configured to enable the given player to cast votes during and/or after the streaming of performance video content in the online casino. The subject matter of the vote may vary as however desired by the performer(s), the provider, administrator, moderator, and/or any other entities related to the online casino. For example, the performer(s) of live performance video content may poll audience as to which song the performer(s) should perform next. In that example, the given player may be facilitated to cast votes through the chat interface provided by the chat component 124 and/or any other field controls (e.g., a vote button associated with a specific option) to cast a vote. The content interaction component 136 may receive the votes cast by the players and provide the vote result to the performer(s). As another example, voting may be facilitated by the content interaction component 136 after streaming of performance video content to determine if the performer(s) of performance video content should be invited back to the online casino in future engagements.

In some examples, the content interaction component 136 may be configured to facilitate the given player to request the performer(s) to perform a specific act during the performance. For example, without limitation, a given player may be enabled, through the chat interface embedded in the casino interface, to request a performer of live performance video content to pay a tribute to his/her friend who is also viewing the live performance video content being streamed in the online casino. In another example, the given player may be enabled to request the performer to perform his/her favorite song as a tribute to the friend. In some implementations, offers of enabling the given player to request such special performance may be presented to the given player in exchange for consideration from the given player. For example, an offer may be presented to the given player such that the given player may spend 10 tickets in order for the performer(s) to read a phase composed by the given player, for example, a thank you, happy birthday, congratulations, and/or any other types of messages to a friend of the given player who is also viewing the performance video content. Other examples are contemplated.

In some implementations, the content interaction component may be configured to provide a player a level of content interaction based on virtual currency, progress in the online game, progress in an event (e.g., a tournament), contents or player status in the online game, and/or any consideration. For example, access to a set of interaction features (e.g., individual chat with the performer, performance request, and/or any other interaction features) may be activated after a player has paid an amount of virtual currency in exchange for access to the set of features, achieved a milestone in the online game or in an event in the online casino, reached a level in the online casino (e.g., VIP status, a membership and/or any other level), and/or any other consideration.

The server 102, client computing platforms 104, and/or external resources 106 may be operatively linked via one or more electronic communication links. For example, such electronic communication links may be established, at least in part, via a network such as the Internet and/or other networks. It will be appreciated that this is not intended to be limiting, and that the scope of this disclosure includes implementations in which servers 102, client computing platforms 104, and/or external resources 106 may be operatively linked via some other communication media.

A given client computing platform 104 may include one or more processors configured to execute computer program components. The computer program components may be configured to enable a player or personnel of online casino associated with the given client computing platform 104 to interface with system 100 and/or external resources 106, and/or provide other functionality attributed herein to client computing platforms 104. By way of non-limiting example, the given client computing platform 104 may include one or more of a desktop computer, a laptop computer, a handheld computer, a tablet computing platform, a NetBook, a Smartphone, a gaming console, and/or other computing platforms.

The external resources 106 may include sources of information, hosts and/or providers of Internet services outside of system 100, external entities participating with system 100, and/or other resources. In some implementations, some or all of the functionality attributed herein to external resources 106 may be provided by resources included in system 100.

The server 102 may include electronic storage 110, one or more processors 108, and/or other components. The server 102 may include communication lines or ports to enable the exchange of information with a network and/or other computing platforms. Illustration of server 102 in FIG. 1 is not intended to be limiting. The server 102 may include a plurality of hardware, software, and/or firmware components operating together to provide the functionality attributed herein to server 102. For example, server 102 may be implemented by a cloud of computing platforms operating together as server 102.

Electronic storage 110 may comprise electronic storage media that electronically stores information. The electronic storage media of electronic storage 110 may include one or both of system storage that is provided integrally (i.e., substantially non-removable) with server 102 and/or removable storage that is removably connectable to server 102 via, for example, a port (e.g., a USB port, a FireWire port, etc.) or a drive (e.g., a disk drive, etc.). Electronic storage 110 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 110 may include one or more virtual storage resources (e.g., cloud storage, a virtual private network, and/or other virtual storage resources). Electronic storage 110 may store software algorithms, information determined by processor 108, information received from server 102, information received from client computing platforms 104, and/or other information that enables server 102 to function as described herein.

Processor(s) 108 is configured to provide information processing capabilities in server 102. As such, processor 108 may include one or more of a digital processor, an analog processor, a digital circuit designed to process information, an analog circuit designed to process information, a state machine, and/or other mechanisms for electronically processing information. Although processor 108 is shown in FIG. 1 as a single entity, this is for illustrative purposes only. In some implementations, processor 108 may include a plurality of processing units. These processing units may be physically located within the same device, or processor 108 may represent processing functionality of a plurality of devices operating in coordination. The processor 108 may be configured to execute components 112, 114, 116, 118, 120, 122, 124, 126, 128, 130, 132, 134, 136. Processor 108 may be configured to execute components 112, 114, 116, 118, 120, 122, 124, 126, 128, 130, 132, 134, 136 by software; hardware; firmware; some combination of software, hardware, and/or firmware; and/or other mechanisms for configuring processing capabilities on processor 108.

It should be appreciated that, although components 112, 114, 116, 118, 120, 122, 124, 126, 128, 130, 132, 134, 136 are illustrated in FIG. 1 as being co-located within a single processing unit, in implementations in which processor 108 includes multiple processing units, one or more of components 112, 114, 116, 118, 120, 122, 124, 126, 128, 130, 132, 134, 136 may be located remotely from the other components. The description of the functionality provided by the different components 112, 114, 116, 118, 120, 122, 124, 126, 128, 130, 132, 134, 136 described below is for illustrative purposes, and is not intended to be limiting, as any of components 112, 114, 116, 118, 120, 122, 124, 126, 128, 130, 132, 134, 136 may provide more or less functionality than is described. For example, one or more of components 112, 114, 116, 118, 120, 122, 124, 126, 128, 130, 132, 134, 136 may be eliminated, and some or all of its functionality may be provided by other ones of components 112, 114, 116, 118, 120, 122, 124, 126, 128, 130, 132, 134, 136. As another example, processor 108 may be configured to execute one or more additional components that may perform some or all of the functionality attributed below to one of components 112, 114, 116, 118, 120, 122, 124, 126, 128, 130, 132, 134, 136.

Figure 15:
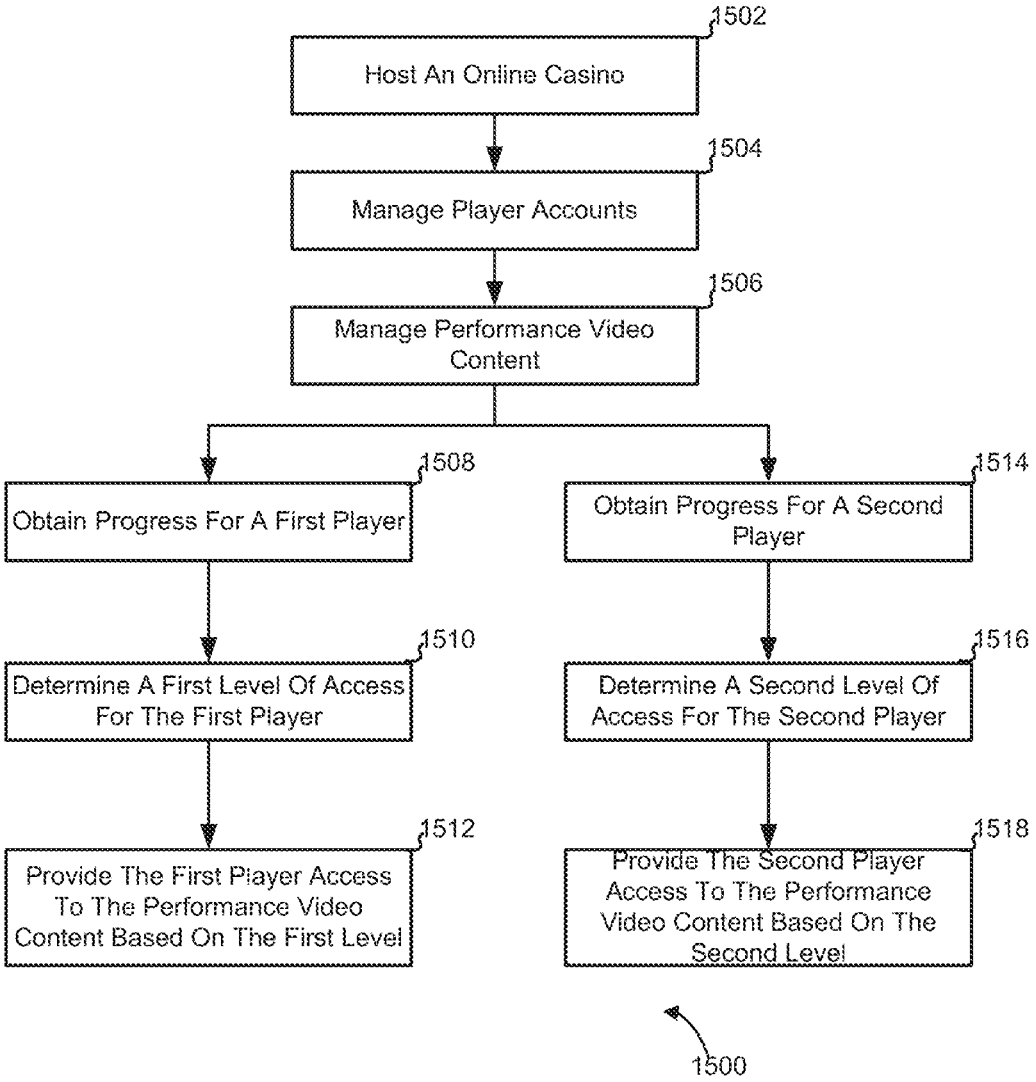
FIG. 15 illustrates one example of a method for providing performance video content in an online casino in accordance with the disclosure.

FIG. 15 illustrates one example of method 1500 for providing performance video content in an online casino in accordance with the disclosure. The operations of method 1500 presented below are intended to be illustrative. In some embodiments, method 1500 may be accomplished with one or more additional operations not described, and/or without one or more of the operations discussed. Additionally, the order in which the operations of method 1500 illustrated in FIG. 15 and described below is not intended to be limiting.

In some embodiments, method 1500 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 1500 in response to instructions stored electronically on an electronic storage medium. The one or more processing devices may include one or more devices configured through hardware, firmware, and/or software to be specifically designed for execution of one or more of the operations of method 1500.

At an operation 1502, an instance of an online game may be hosted for player participation. Hosting the online casino may include providing multiple casino-style games for player participation. Examples of casino-style games provided the online casino hosted in operation 1502 may include virtual slot, poker, blackjack, roulette, bingo, pachinko, baccarat, raffles, lottery, sports betting, and/or any other casino-style games. In some implementations, operation 1502 may be performed by a casino component the same as or similar to casino component 112 (shown in FIG. 1 and described herein).

At an operation 1504, player accounts may be managed for individual players of the online casino. The individual player accounts managed in operation 1504 may include player information associated with players of the online casino. The player information in a given player's account may include progress information indicating progress by the given player in the online casino. Progress by a given player in the online casino may reflect events, activities, actions, winnings, losses, purchases, social interaction with other players, a VIP status, a membership in the online casino, and/or any other types of progress by the given player during the given player's engagement with the online casino. In some implementations, operation 1504 may be performed by a player component the same as or similar to player component 114 (shown in FIG. 1 and described herein).

At operation 1506, one or more sets of performance video content may be managed for the online casino. A given set of performance video content managed in operation 1506 may contain performance by one or more performers. Examples in the given set of performance video content may include, without limitation, talk show, concert, comedy, musical show, magic show, learning show, dance show, and/or any other types of performance. The performance in the given set of performance video content may be live, near-live, and/or recorded. Managing the one or more sets of performance video content in operation 1506 may involve adding/modifying attribute information, captioning, categorizing, archiving, tagging, storing, automatically deleting, sorting, and/or any other type of operations for managing the set(s) of performance video content. In some implementations, operation 1506 may be performed by a performance video content component the same as or similar to performance video content component 116 (shown in FIG. 1 and described herein).

At an operation 1508, progress for a first player of the online casino may be obtained. This may involve examining player information in the first player's account managed in operation 1504. Operation 1508 may include analyzing the player information in the first player's account and determine a progress of the first player in the online game based on a result of the analysis and/or any other operations. In some implementations, the analysis may be performed in operation 1508 dynamically. By way of non-limiting example, in one implementation, analysis may be performed in operation 1508 at a request of personnel of the online casino. In that implementation, analytical information may be provided by the personnel for performing the analysis by operation 1508. In some implementations, operation 1508 may be performed by an access management component 118 the same as or similar to access management component 118 (shown in FIG. 1 and described herein).

At an operation 1510, a first level of access to performance video content may be determined for the first player based on the progress of the first player in the online casino as determined in operation 1508. The first level of access to the performance video content may reflect a number of different aspects. For example, without limitation, the first level of access may reflect streaming quality, video resolution, available controls, and/or any other aspects regarding presentation of the performance video content to the first player in the online casino. As another example, the first level of access may reflect one or more types of performance video content available to the first player in the online casino. For instance, the first level of access may reflect the first player may have access recorded show but may not have access to live show. Other aspects that may be reflect by the first level of access determined for the first player may include access period, available method(s) for accessing, and/or any other aspects. In some implementations, operation 1510 may be performed by access management component 118 the same as or similar to access management component 118 (shown in FIG. 1 and described herein).

At an operation 1512, access to performance video content may be provided to the first player in the online casino in accordance with the first access level determined for the first player in operation 1512. Providing such access to the first player may include enabling the first player to view performance video content while placing wager in a casino-style game through a casino interface. The casino interface may include controls that facilitate the first player to play a casino-style game. The first player may be enabled to view the performance video content in an area within the casino interface in accordance with the first access level. Such an area in the casino interface may include a virtual stage, a virtual theater, and/or any other types of area performance video content may be shown. In some implementations, operation 1512 may be performed by interface component the same as or similar to interface component 120 (shown in FIG. 1 and described herein).

At an operation 1514, progress for a second player of the online casino may be obtained. The progress obtained for the second player in operation 1514 may be different that obtained for the first player in operation 1508. This may involve examining player information in the second player's account managed in operation 1504. Operation 1514 may include analyzing the player information in the second player's account and determine a progress of the second player in the online game based on a result of the analysis and/or any other operations. In some implementations, the analysis may be performed in operation 1514 dynamically. By way of non-limiting example, in one implementation, analysis may be performed in operation 1514 at a request of personnel of the online casino. In that implementation, analytical information may be provided by the personnel for performing the analysis by operation 1514. In some implementations, operation 1514 may be performed by an access management component 118 the same as or similar to access management component 118 (shown in FIG. 1 and described herein).

At an operation 1516, a second level of access to performance video content may be determined for the second player based on the progress of the second player in the online casino as determined in operation 1514. The second level of access determined for the second player may be different from the first level of access determined for the first player in operation 1510 by virtue of the progress of the second player being different from the first player in the online casino. The second level of access to the performance video content may reflect a number of aspects different from those reflected by the first level of access. For example, without limitation, the access may be differentiated by streaming quality, video resolution, available controls, and/or any other aspects regarding presentation of the performance video content, by availability of the performance video content to the first and second player, by the type of performance video content available to the first and second players, by access period to the performance video content, and/or by any other aspects of access to the performance video content. In some implementations, operation 1516 may be performed by access management component 118 the same as or similar to access management component 118 (shown in FIG. 1 and described herein).

At an operation 1518, access to performance video content may be provided to the second player in the online casino in accordance with the first access level determined for the first player in operation 1516. Providing such access to the second player may include enabling the second player to view performance video content while placing wager in a casino-style game through a casino interface. The casino interface may include controls that facilitate the second player to play a casino-style game. The second player may be enabled to view the performance video content in an area within the casino interface in accordance with the first access level. Such an area in the casino interface may include a virtual stage, a virtual theater, and/or any other types of area performance video content may be shown. In some implementations, operation 1518 may be performed by interface component the same as or similar to interface component 120 (shown in FIG. 1 and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for providing performance video content in an online casino, the system comprising:

one or more physical processors configured by machine-readable instructions to:

host the online casino for participation by players such that players are enabled to place wagers in multiple casino-style games in the online casino through casino interfaces presented to the players on client computing platforms;

manage player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and provide access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the access to the performance video content provided to the first player is different from that provided to the second player with respect to streaming quality and/or video resolution.

2. The system of claim 1, wherein the progress by the first player is different from the progress by the second player in the online casino with respect to historical purchases and/or current balances of virtual items, currencies and/or chips by the first player and second player in the online casino respectively.

3. The system of claim 1, wherein the one or more physical processors are further configured by machine-readable instructions to responsive to the second player purchasing a ticket, increase the level of the access to the performance video content in the online casino for the second player such that the increased level of the access is greater than that of the access provided to the second player based on the progress by the second player in the online casino without the ticket.

4. The system of claim 1, wherein a payout of the online casino includes improved access to the performance video content in the online casino.

5. The system of claim 4, wherein the improved access to the performance video content in the online casino includes accessing the performance video content as past video on demand.

6. The system of claim 1, wherein the access to the performance video content provided to the first player is different from that provided to the second player such that access to some of the performance video content is provided to the first player but is not provided to the second player.

7. The system of claim 1, wherein the some of the performance video content accessible to the first player but not accessible to the second player in the online casino includes one or more real-time or near real-time performances, extras to one or more performances and/or one or more comic entertainment performances.

8. The system of claim 1, wherein the access to performance video content provided to the first player and the second player is different such that there exists at least one time period during which access to the performance video content is available to the first player but not available to the second player.

9. The system of claim 1, wherein the casino interfaces include a first casino interface and wherein the one or more processors are further configured by the machine-readable instructions to facilitate the players to chat, through the first casino interface, with other players such that the first player is facilitated to chat with the second player.

10. The system of claim 1, wherein the one or more processors are further configured by the machine-readable instructions to generate notifications for transmission through medium external to the online casino, the notifications including information that advertises the performance video content is available for access in the online casino.

11. The system of claim 1, wherein the one or more processors are further configured by the machine-readable instructions to facilitate players of the online casino to invite friends to access the performance video content within the online casino such that the first player is facilitated to invite one or more friends of the first player to access the performance video content within the online casino.

12. The system of claim 1, wherein the performance video content includes one or more songs, comedies, entertainment shows, musicals, documentaries and/or movies.

13. The system of claim 1, wherein the casino games include a first casino game and wherein the one or more processors are further configured by the machine-readable instructions to facilitate the players to interact with the performance video content such that the first player is facilitated to interact with the performance video content while the first player is engaging in the first casino game through a casino interface.

14. The system of claim 13, wherein facilitating the interaction with the performance video content includes facilitating the first player to vote on one or more of the performers performing in the performance video content.

15. The system of claim 13, wherein the casino interfaces include a first casino interface and wherein facilitating the interaction with the performance video content includes facilitating the first player to chat, through the first casino interface, with a performer of the performance video content.

16. A system for providing performance video content in an online casino, the system comprising:

one or more physical processors configured by machine-readable instructions to:

host the online casino for participation by players such that players are enabled to place wagers in multiple casino-style games in the online casino through casino interfaces presented to the players on client computing platforms;

manage player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and provide access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the casino interfaces include a first casino interface, wherein providing the first player access to the performance video content through the casino interfaces in the online casino includes presenting the first player in the first casino interface a schedule indicating one or more time periods during which multiple sets of performance video content are available for access by the first player in the online casino, and, wherein the schedule is presented in the first casino interface in a rolling manner.

17. The system of claim 16, wherein providing the first player access to the performance video content through the casino interfaces in the online casino includes enabling the first player to view the performance video content through a virtual stage or a virtual theater within the first casino interface.

18. The system of claim 16, wherein the one or more processors are further configured by the machine-readable instructions to enable the first player to register through the first casino interface as an audience to view a set of performance video content in a time period when the set of performance video content is available for access by the first player in the online casino.

19. The system of claim 18, wherein the one or more processors are further configured by the machine-readable instructions to facilitate the first player to incorporate the time period into a calendar provided by an Internet service provider associated with the first player.

20. The system of claim 18, wherein the one or more processors are further configured by the machine-readable instructions to generate notifications for reminding the first player that the first player is registered to view the set of performance video content during the time period.

21. A system for providing performance video content in an online casino, the system comprising:

one or more physical processors configured by machine-readable instructions to:

host the online casino for participation by players such that players are enabled to place wagers in multiple casino-style games in the online casino through casino interfaces presented to the players on client computing platforms;

manage player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and provide access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the one or more processor are further configured by the machine-readable instructions to present players in the casino interfaces offers of virtual items, currencies and/or chips for purchase in the online casino game in connection with the performance video content such that a first offer is presented to the first player in connection with the performance video content in the casino interfaces.

22. The system of claim 21, wherein the first offer is presented to the first player during the viewing of the performance video content by the first player.

23. The system of claim 21, wherein presenting offers in the casino interfaces including presenting a second offer to a second player such that the second offer is different from the first offer presented to the first player.

24. A system for providing performance video content in an online casino, the system comprising:

one or more physical processors configured by machine-readable instructions to:

host the online casino for participation by players such that players are enabled to place wagers in multiple casino-style games in the online casino through casino interfaces presented to the players on client computing platforms;

manage player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and provide access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the casino games include a first casino game and wherein the one or more processors are further configured by the machine-readable instructions to facilitate the players to interact with the performance video content such that the first player is facilitated to interact with the performance video content while the first player is engaging in the first casino game through a casino interface, wherein facilitating the interaction with the performance video content includes facilitating the first player to request a performer to perform an action in the performance video content.

25. The system of claim 24, wherein facilitating the first player to request the performer to perform the action in the performance video content includes presenting, through a casino interface, to the first player an offer to effectuate such a request by the first player in exchange for consideration from the first player.

26. A method for providing performance video content in an online casino, the method being implemented in one or more physical processors configured to execute computer programs, the method comprising:

hosting the online casino for participation by players such that players are enabled to place wagers in multiple casino-style games in the online casino through casino interfaces presented to the players on client computing platforms;

managing player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and providing access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the access to the performance video content provided to the first player is different from that provided to the second player with respect to streaming quality and/or video resolution.

27. The method of claim 26, wherein the progress by the first player is different from the progress by the second player in the online casino with respect to historical purchases and/or current balances of virtual items, currencies and/or chips by the first player and second player in the online casino respectively.

28. The method of claim 26, wherein the progress by the first player is different from the progress by the second player in the online casino with respect to levels of membership in a membership program by the first and second players respectively, the membership program being associated with the online casino.

29. The method of claim 26, further comprising responsive to the second player purchasing a ticket, increasing the level of the access to the performance video content in the online casino for the second player such that the increased level of the access is greater than that of the access provided to the second player based on the progress by the second player in the online casino without the ticket.

30. The method of claim 26, wherein a payout of the online casino includes improved access to the performance video content in the online casino.

31. The method of claim 30, wherein the improved access to the performance video content in the online casino includes accessing the performance video content as past video on demand.

32. The method of claim 26, wherein the access to the performance video content provided to the first player is different from that provided to the second player such that access to some of the performance video content is provided to the first player but is not provided to the second player.

33. The method of claim 32, wherein the some of the performance video content accessible to the first player but not accessible to the second player in the online casino includes one or more real-time or near real-time performances, extras to one or more entertainment performances and/or one or more comic entertainment performances.

34. The method of claim 26, wherein the access to performance video content provided to the first player and the second player is different such that there exists at least one time period during which access to the performance video content is available to the first player but not available to the second player.

35. The method of claim 26, wherein the casino interfaces include a first casino interface and wherein the method further comprising facilitating the players to chat, through the first casino interface, with other players such that the first player is facilitated to chat with the second player.

36. The method of claim 26, wherein the casino interfaces include a first casino interface and wherein providing the first player access to the performance video content through the casino interfaces in the online casino includes enabling the first player to view the performance video content through a virtual stage or a virtual theater within the first casino interface.

37. The method of claim 26, wherein the casino interfaces include a first casino interface and wherein providing the first player access to the performance video content through the casino interfaces in the online casino includes presenting the first player in the first casino interface a schedule indicating one or more time periods during which multiple sets of performance video content are available for access by the first player in the online casino.

38. The method of claim 26, further comprising generating notifications for transmission through medium external to the online casino, the notifications including information that advertises the performance video content is available for access in the online casino.

39. The method of claim 26, further comprising facilitating players of the online casino to invite friends to access the performance video content within the online casino such that the first player is facilitated to invite one or more friends of the first player to access the performance video content within the online casino.

40. The method of claim 26, wherein the performance video content includes one or more songs, comedies, entertainment shows, musicals, documentaries and/or movies.

41. The method of claim 26, wherein the casino games include a first casino game and wherein the method further comprises facilitating the players to interact with the performance video content such that the first player is facilitated to interact with the performance video content while the first player is engaging in the first casino game through a casino interface.

42. The method of claim 41, wherein facilitating the interaction with the performance video content includes facilitating the first player to vote on one or more of the performers performing in the performance video content.

43. The method of claim 41, wherein facilitating the interaction with the performance video content includes facilitating the first player to request a performer to perform an action in the performance video content.

44. The method of claim 43, wherein facilitating the first player to request the performer to perform the action in the performance video content includes presenting, through a casino interface, to the first player an offer to effectuate such a request by the first player in exchange for consideration from the first player.

45. The method of claim 41, wherein the casino interfaces include a first casino interface and wherein facilitating the interaction with the performance video content includes facilitating the first player to chat, through the first casino interface, with a performer of the performance video content.

46. A method for providing performance video content in an online casino, the method being implemented in one or more physical processors configured to execute computer programs, the method comprising:

hosting the online casino for participation by players such that players are enabled to place wagers in multiple casino-style games in the online casino through casino interfaces presented to the players on client computing platforms;

managing player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and providing access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the casino interfaces include a first casino interface and wherein providing the first player access to the performance video content through the casino interfaces in the online casino includes presenting the first player in the first casino interface a schedule indicating one or more time periods during which multiple sets of performance video content are available for access by the first player in the online casino, wherein the schedule is presented in the first casino interface in a rolling manner.

47. The method of claim 46, further comprising enabling the first player to register through the first casino interface as an audience to view a set of performance video content in a time period when the set of performance video content is available for access by the first player in the online casino.

48. The method of claim 47, further comprising facilitating the first player to incorporate the time period into a calendar provided by an Internet service provider associated with the first player.

49. The method of claim 47, further comprising generating notifications for reminding the first player that the first player is registered to view the set of performance video content during the time period.

50. A method for providing performance video content in an online casino, the method being implemented in one or more physical processors configured to execute computer programs, the method comprising:

hosting the online casino for participation by players such that players are enabled to place wagers in multiple casino-style games in the online casino through casino interfaces presented to the players on client computing platforms;

managing player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and providing access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the casino interfaces include a first casino interface and wherein the method further comprises presenting players in the casino interfaces offers of virtual items, currencies and/or chips for purchase in the online casino-style games in connection with the performance video content such that a first offer is presented to the first player in connection with the performance video content in the first casino interface.

51. A method for providing performance video content in an online casino, the method being implemented in one or more physical processors configured to execute computer programs, the method comprising:

hosting the online casino for participation by players such that players are enabled to place wagers in multiple casino-style games in the online casino through casino interfaces presented to the players on client computing platforms;

managing player accounts associated with the players, the player accounts comprising player information indicating progress by the players in the online casino such that a first player account associated with a first player comprising first player information indicating a progress by the first player in the online casino and a second player account associated with a second player comprising second player information indicating a progress by the second player in the online casino are managed, wherein the progress by the first player in the online casino is different from the progress by the second player in the online casino; and providing access to performance video content to the players through the casino interfaces to enable the players to view the performance video content and place wagers in the casino games simultaneously, wherein such access is differentiated based on the player information indicating different progress by the players in the online casino such that the access to the performance video content provided to the first player and the second player is different, wherein the first offer is presented to the first player during the viewing of the performance video content by the first player.

* * * * *